US009347659B2

(12) United States Patent
Inoue et al.

(10) Patent No.: US 9,347,659 B2
(45) Date of Patent: May 24, 2016

(54) AUTOMOTIVE HEADLAMP, HEAT RADIATING MECHANISM, LIGHT-EMITTING APPARATUS AND LIGHT SOURCE FIXING MEMBER

(71) Applicant: Koito Manufacturing Co., Ltd., Tokyo (JP)

(72) Inventors: Takashi Inoue, Shizuoka (JP); Tetsuya Suzuki, Shizuoka (JP); Akihiro Matsumoto, Shizuoka (JP); Naoki Sone, Shizuoka (JP); Takanori Namba, Shizuoka (JP); Hidetada Tanaka, Shizuoka (JP)

(73) Assignee: KOITO MANUFACTURING CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 14/817,488

(22) Filed: Aug. 4, 2015

(65) Prior Publication Data

US 2016/0025321 A1 Jan. 28, 2016

Related U.S. Application Data

(62) Division of application No. 13/493,330, filed on Jun. 11, 2012, now Pat. No. 9,134,003.

(30) Foreign Application Priority Data

| | | |
|---|---|---|
| Jun. 13, 2011 | (JP) | 2011-131425 |
| Jun. 28, 2011 | (JP) | 2011-143274 |
| Jun. 30, 2011 | (JP) | 2011-146267 |
| Jan. 10, 2012 | (JP) | 2012-002289 |

(51) Int. Cl.
*F21V 21/00* (2006.01)
*F21S 8/10* (2006.01)
(Continued)

(52) U.S. Cl.
CPC ..... *F21V 29/763* (2015.01); *F21S 48/328* (2013.01); *F21V 19/0025* (2013.01)

(58) Field of Classification Search
CPC ... F21V 29/769; F21V 19/0025; F21S 48/328
See application file for complete search history.

(56) References Cited

U.S. PATENT DOCUMENTS

| | | | |
|---|---|---|---|
| 2002/0126494 | A1 | 9/2002 | Tanaka et al. |
| 2006/0291229 | A1 | 12/2006 | Tajima |

(Continued)

FOREIGN PATENT DOCUMENTS

| | | | |
|---|---|---|---|
| CN | 1884906 | A | 12/2006 |
| CN | 101440923 | A | 5/2009 |

(Continued)

OTHER PUBLICATIONS

Chinese Office Action (The First Office Action) dated Apr. 3, 2014, issued by the State Intellectual Property Office of the People's Republic of China in corresponding Chines Patent Application No. 201210192590.3, and English language translation of Office Action. (14 pages).

(Continued)

*Primary Examiner* — Joseph L Williams
(74) *Attorney, Agent, or Firm* — Buchanan Ingersoll & Rooney PC

(57) ABSTRACT

In an automotive headlamp, a light-emitting module is configured such that a light-emitting element and a control circuit unit for controlling the lighting of the light-emitting element are structured integrally with each other. A control circuit unit in a position anterior to the light-emitting element in a lamp unit is located below a shade section so that the control circuit unit can be clear of the path of light used to form a low beam light distribution pattern of the light emitted by the light-emitting element. In this setting, the light-emitting element is so located that a main optical axis Ax2 is perpendicular respect to an optical axis Ax1 of the lamp unit and that a light-emitting portion of the light-emitting element protrudes higher than the control circuit unit in the direction of the main optical axis Ax2.

9 Claims, 25 Drawing Sheets

(51) Int. Cl.
*F21V 29/76* (2015.01)
*F21V 19/00* (2006.01)

(56) References Cited

U.S. PATENT DOCUMENTS

2009/0129111 A1 5/2009 Ito et al.
2012/0294026 A1 11/2012 Matsumoto et al.

FOREIGN PATENT DOCUMENTS

CN 102032516 A 4/2011
JP 2005-32661 A 3/2005
JP 2007-305455 A 11/2007
JP 2008-186796 A 8/2008

OTHER PUBLICATIONS

Chinese Office Action dated Nov. 25, 2014 issued in the corresponding Chinese Patent Application No. 201210192590.3 and English language translation (14 pages).

Japanese Notification of Reason(s) for Refusal dated Jan. 27, 2015 issued the corresponding Japanese Patent Application No. 2011-146267 and English translation.

P-P

Q-Q

AUTOMOTIVE HEADLAMP, HEAT RADIATING MECHANISM, LIGHT-EMITTING APPARATUS AND LIGHT SOURCE FIXING MEMBER

CROSS-REFERENCE TO RELATED APPLICATIONS

The present application is a divisional of U.S. patent application Ser. No. 13/493,330, filed on Jun. 11, 2012, and claims the benefit of prior Japanese Patent Application No. 2011-131425, filed on Jun. 13, 2011, Japanese Patent Application No. 2011-143274, filed on Jun. 28, 2011, Japanese Patent Application No. 2011-146267, filed on Jun. 30, 2011, and Japanese Patent Application No. 2012-002289, filed on Jan. 10, 2012, the entire contents of each of which are incorporated herein by reference.

BACKGROUND OF THE INVENTION

1. Field of the Invention

The present invention relates to an automotive headlamp, and more particularly to an automotive headlamp having a light-emitting module including a control circuit unit for controlling the lighting of a light source.

2. Description of the Related Art

There is a known technology for utilizing light-emitting elements, such as LEDs (Light Emitting Diodes), as the light source of an automotive headlamp. In such a technology as disclosed in Japanese Patent Application Publication No. 2005-32661, a light source apparatus is proposed in which at least one of the electrical coupling means coupling the light-emitting elements with the mounting substrate is so disposed as to pass across an area in the irradiation direction as seen from the light-emitting elements.

Recent years have seen the emergence of various applications that require complex lighting control for automotive headlamps. In such applications, a control circuit for controlling the lighting of the light-emitting elements is provided independently of the mounting substrate to which the light-emitting elements are directly mounted as in the case described above. However, there are growing demands for the space occupied by the automotive headlamps to be smaller because of the limited space within a vehicle. Thus, the location of this control circuit is an extremely important consideration from the viewpoint of reduction in the space occupied by the automotive headlamps.

SUMMARY OF THE INVENTION

The present invention has been made to solve the above-described problems, and a purpose thereof is to provide a technology for limiting the space to be occupied by automotive headlamps.

To resolve the foregoing problems, an automotive headlamp according to one embodiment of the present invention includes: a light-emitting module configured such that a light source and a control circuit unit for controlling the lighting of the light source are structured integrally with each other; and a reflector having a reflecting surface for reflecting light emitted from the light source and collecting the reflected light. The control circuit unit is disposed in a position anterior to the light source in a lamp unit.

BRIEF DESCRIPTION OF THE DRAWINGS

Embodiments will now be described by way of examples only, with reference to the accompanying drawings which are meant to be exemplary, not limiting and wherein like elements are numbered alike in several Figures in which.

DETAILED DESCRIPTION OF THE INVENTION

Figure 1:
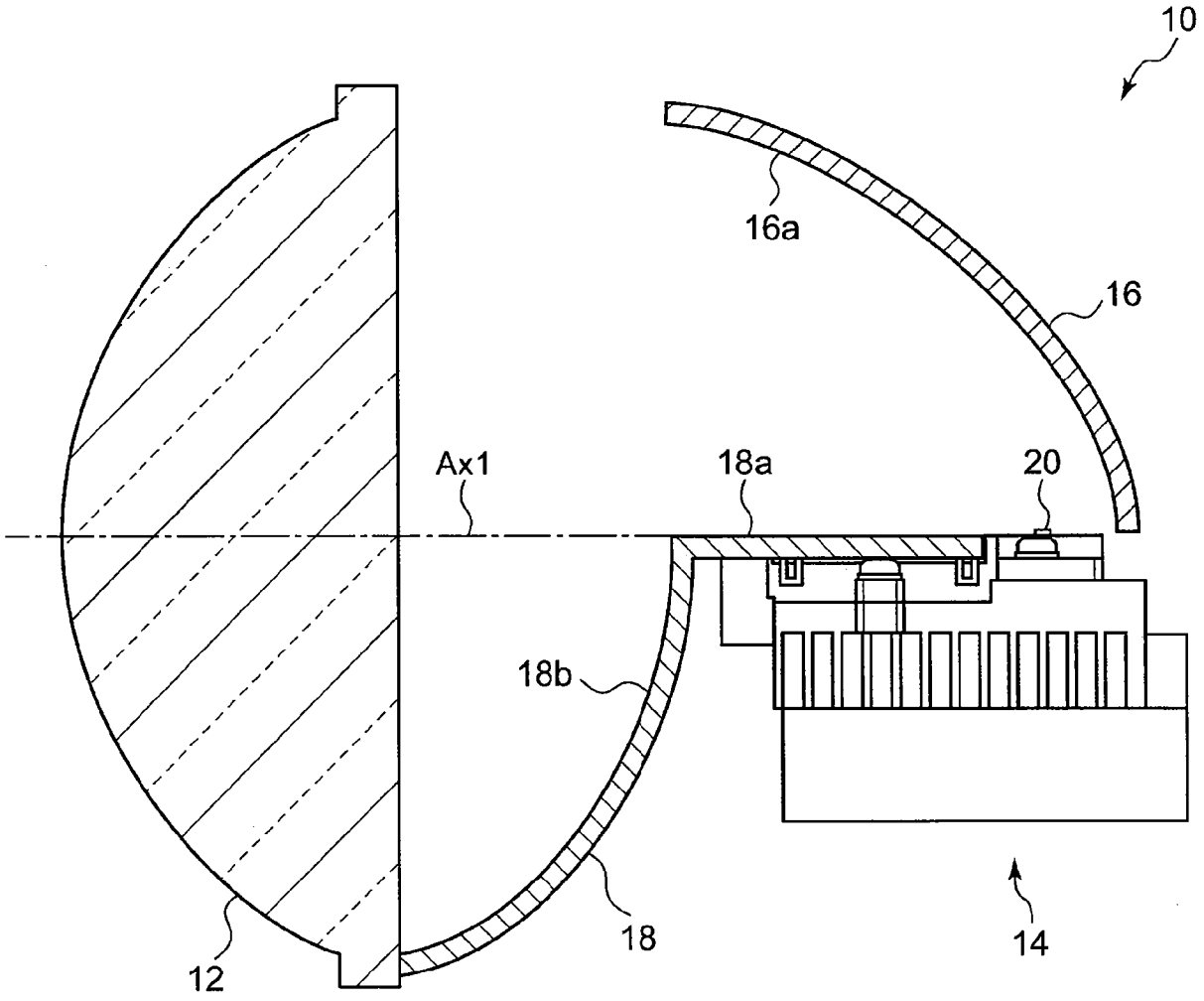
FIG. 1 shows a structure of an automotive headlamp according to a first embodiment of the present invention.

The invention will now be described by reference to the preferred embodiments. This does not intend to limit the scope of the present invention, but to exemplify the invention.

An automotive headlamp according to first to ninth embodiments of the present invention includes a light-emitting module, in which a light source and a control circuit unit for controlling the lighting of the light source are structured integrally with each other, and a reflector having a reflecting surface for reflecting light emitted from the light source and focusing (collecting) the reflected light. The control circuit unit is disposed in a position anterior to the light source in a lamp unit.

In the automotive headlamp, optical components, such as a reflector, a shade and the like are normally disposed in positions anterior to the light source in the lamp unit. However, if the control circuit unit is located in a position posterior to the light source in the lamp unit to avoid the interference between such components and the control circuit unit, then the control circuit unit will protrude in the posterior direction from the light source, thus making it difficult to limit the space occupied by the automotive headlamp. According to the present embodiments, however, the control circuit unit can be located in a position anterior to the light source in the lamp unit, so that the protrusion of the control circuit unit in the posterior direction from the light source can be avoided. This configuration and arrangement prevent any increase in space to be occupied by the control circuit unit.

The control circuit unit in a position anterior to the light source in the lamp unit may be so located as to be clear of the path of light used to form a light distribution pattern of the light emitted by the light source.

Location of the control circuit unit anterior to the light source within the lamp unit can produce unwanted effects of its shadow or reflected light on the light distribution pattern. According to the present embodiment of the invention, the adverse effects on the light distribution pattern that may be caused by the arrangement where the control circuit unit is disposed anterior to the light source in the lamp unit can be avoided by locating the control circuit unit clear of the path of light to form the light distribution pattern.

The light-emitting module may further include a cover that covers at least a part of the control circuit unit. The cover may have a shade portion capable of forming a peripheral or edge part of the light distribution pattern by shielding a part of the light emitted from the light source.

According to this embodiment, the number of components can be made smaller than when the cover of the control circuit unit and the shade are provided separately. This also makes parts management easier.

The light source may be so disposed that its main optical axis is perpendicular to the optical axis of the lamp unit and the light-emitting portion thereof protrudes more in the direction of the main optical axis than the control circuit unit.

According to this embodiment, the main optical axis of the light source being perpendicular to the optical axis of the lamp unit makes it possible to form a light distribution pattern more effectively through the reflector. Also, the light-emitting portion protruding more in the direction of the main optical axis than the control circuit unit makes it possible to avoid the location of the control circuit unit in a front position anterior to the light-emitting portion in the lamp unit, and there will be no adverse effects on the light distribution pattern.

The light-emitting module may include a fixed connector that is so provided as to allow connection of a wire connector. The fixed connector may be disposed in a position anterior to the light source in the lamp unit and clear of the path of light such that the fixed connector allows connection of the wire connector which is brought closer to the path of light through an area clear of the path of light.

According to this embodiment, there will be least effects of its shadow or reflected light of the wire connector on the light distribution pattern. Also, the wire connector is so structured as to have a wire in the rear as the wire connector is brought to connect to the fixed connector. Hence, as the wire connector is brought to connect to the fixed connector in a direction approaching the path of light, the wire led out from the wire connector can be located further away from the path of light. The wire, which is flexible, may possibly deform and stray into the path of light once it is subjected to some external force. However, the location of the wire further apart from the path of light can minimize the possibilities of adverse effect of stray wire on the light distribution pattern.

A fan for cooling the light source may further be provided. The control circuit unit may further have a function of controlling the drive of the fan. The light-emitting module may have a fan connector for connecting the fan to the control circuit unit. According to this embodiment, it is no longer necessary to provide a control circuit unit for the fan separately from the control circuit unit for controlling the lighting of the light source. As a result, the space for locating an additional control circuit may be eliminated.

The light-emitting module may further have a single input connector through which a first control signal used to control the lighting of the light source and a second control signal used to control the drive of the fan are inputted. According to this embodiment, both the first control signal and the second control signal can be inputted by simply connecting another single connector capable of outputting the first control signal and second control signal to the single input connector. Thus, the number of processes required for assembly can be reduced from the case when the connector for the first control signal and the connector for the second control signal are provided separately.

A support member to support the reflector may be further provided. The support member may have a holding section into which the control circuit unit is inserted in an anterior direction of the lamp unit and a securing section that secures the light-emitting module abutting an anterior position in the lamp unit after the insertion of the control circuit unit. According to this embodiment, the light-emitting module may be attached to the support member by a simple process of securing it as it is inserted in an anterior direction of the lamp unit. This easy attachment and detachment of the light-emitting module makes assembly and maintenance easier, too.

Hereinbelow, the embodiments will now be described in detail with reference to drawings.

First Embodiment

FIG. 1 shows a structure of an automotive headlamp 10 according to a first embodiment of the present invention. FIG. 1 is a vertical cross-sectional view, of the automotive headlamp 10, including an optical axis Ax1 of a lamp unit. The automotive headlamp 10 functions as a so-called low-beam light source that forms a low-beam light distribution pattern. It should be noted that the automotive headlamp 10 is not limited to that described above and the automotive headlamp 10 may function as a high-beam light source that forms a high-beam light distribution pattern.

The automotive headlamp 10 includes a projection lens 12, a light-emitting module 14, a reflector 16, and a shade 18. The projection lens 12 is a plano-convex aspheric lens, having a convex front surface and a plane rear surface, which projects a light source image formed on a rear focal plane toward a front area of the lamp unit as a reverted image.

The light-emitting module 14 has a light-emitting element 20 constituted by LEDs, which are semiconductor light-emitting elements. It is to be noted that the light-emitting element 20 may be constituted by any other light-emitting elements than LEDs, and an electric-discharge lamp, an incandescent lamp, or the like may be used as the light source in the place of the light-emitting element 20. The light-emitting module 14 is disposed such that the light-emitting element 20 emits light mainly upward.

The reflector 16 has a reflecting surface 16*a* that reflects and focuses the light emitted by the light-emitting element 20. The reflector 16 is disposed such that the reflecting surface 16*a* is located above and opposite to the light-emitting element 20. The shade 18 has a shade section 18*a* and a dummy section 18*b*. The shade section 18*a* has a plane containing the optical axis Ax1 of the lamp unit, which defines a cutoff line near the horizontal line of the low-beam light distribution pattern. Note that a description of the shape of the shade section 18*a*, which is known in the art, is omitted. The dummy section 18*b* functions as a design-designated member which constitutes a design surface visible from the outside.

Figure 2A:
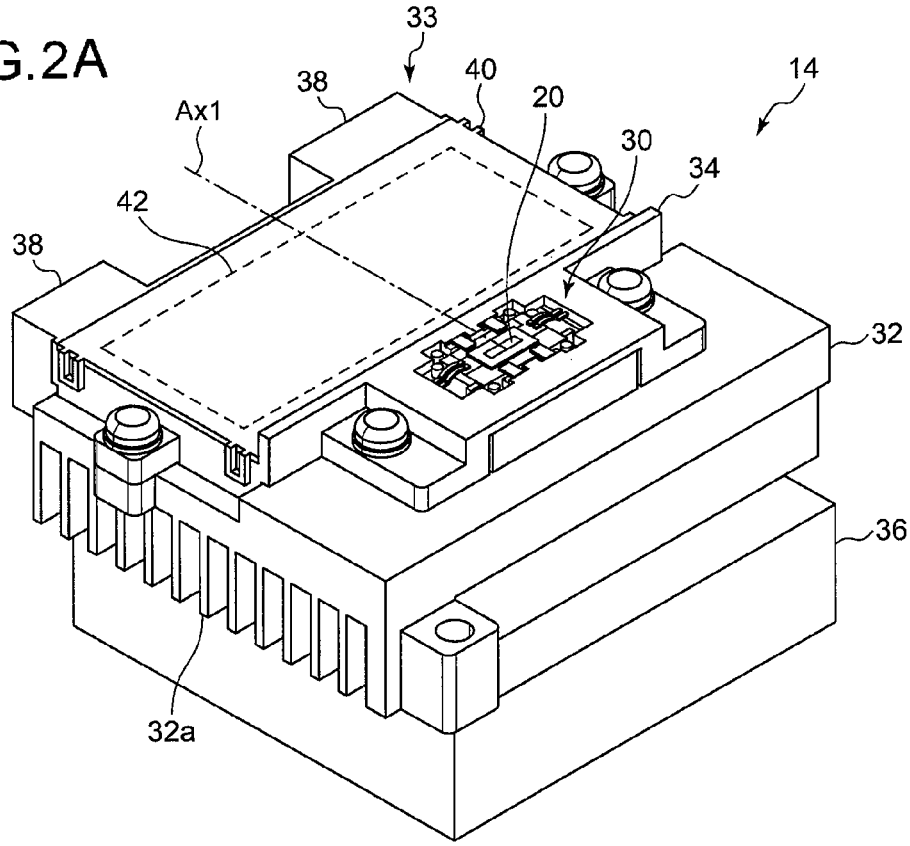
FIG. 2A is a perspective view showing a structure of a light-emitting module according to a first embodiment.
Figure 2B:
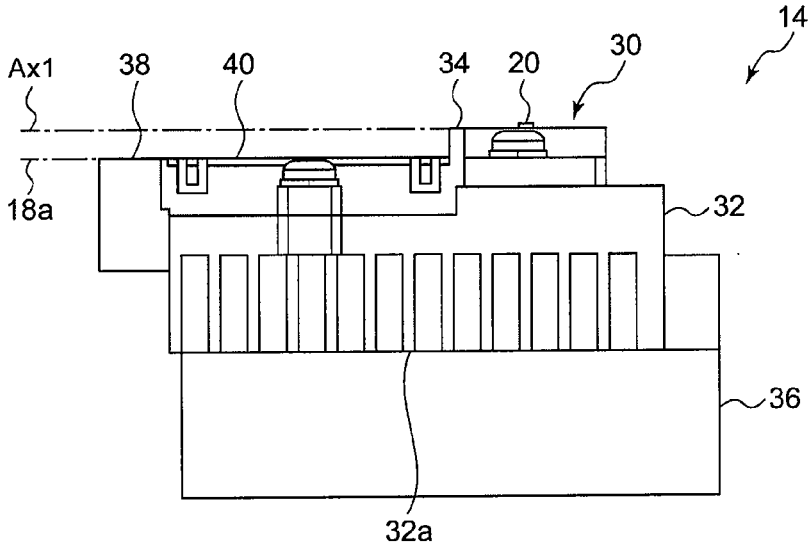
FIG. 2B is a side view of a light-emitting module according to the first embodiment.

FIG. 2A is a perspective view showing a structure of the light-emitting module 14 according to the first embodiment of the present invention. FIG. 2B is a side view of the light-emitting module 14 according to the first embodiment. The light-emitting module 14 includes a package 30, a heatsink 32, an attachment 34, a fan 36, a cover 40, and a control circuit unit 42.

The package 30 includes a light-emitting element 20. The control circuit unit 42 controls the lighting of the light-emitting element 20. According to this embodiment, the control circuit unit 42 is configured by a printed-circuit board and electrical components and elements mounted on the printed-circuit board.

The heatsink 32 is made of a highly heat radiant material, such as aluminum. The heatsink 32 has heat radiation fins 32*a* that radiate heat generated by the light-emitting element 20 and the control circuit unit 42. Also, the arrangement may be such that the heatsink 32 has a first heatsink for dissipating the heat from the light-emitting element 20 and a second heatsink for dissipating the heat from the control circuit unit 42. The attachment 34 is mounted on the top face of the heatsink 32, thereby installing the package 30 on the top face of the heatsink 32.

The heat radiation fins 32*a* of the heatsink 32 are provided in a lower part of the heatsink 32. The heat radiation fins 32*a* are provided in such a manner as to extend in a direction perpendicular to the optical axis Ax1 of the lamp unit. The fan 36 is mounted to the heatsink 32 below the heat radiation fins 32*a* such that the fan 36 can blow air to the heat radiation fins 32*a*.

The attachment 34 has a fixed connector 38 integrally secured thereto by a resin integral molding. The fixed connector 38 is so provided as to allow connection of a wire connector. The attachment 34 also has a circuit holding section which is a downward recess to hold the control circuit unit 42. The control circuit unit 42 is held in this circuit holding section. After the control circuit unit 42 is placed therein, the cover 40 is attached to the attachment 34. It is also to be noted that the cover 40 may be excluded. Also, in the place of the cover 40, the arrangement may be such that a resin molding is applied to the circuit holding section after the placement of the control circuit unit 42 therein.

The control circuit unit 42 is such that the length thereof in the direction perpendicular to the optical axis Ax1 of the lamp unit is greater than the length thereof in the direction parallel thereto. More specifically, the length thereof in the direction perpendicular to the optical axis Ax1 of the lamp unit is more than twice that in the direction parallel thereto. Provision of the control circuit unit 42 in this manner can reduce the length of the light-emitting module 14 in the direction of the optical axis Ax1 of the lamp unit, thus contributing to the further downsizing of the automotive headlamp 10.

The attachment 34, the control circuit unit 42, and the cover 40 constitute an attachment unit 33. In the first embodiment, the control circuit unit 42 and the cover 40 are installed in advance on the attachment 34 before the attachment 34 is mounted on the heatsink 32, and the control circuit unit 42 and the cover 40 are mounted on the heatsink 32 as the attachment unit 33. As a result, the attachment 34 and the control circuit unit 42 are mounted integrally on the heatsink 32, and at the same time the package 30 is installed in such a manner as to be held between the attachment 34 and the heatsink 32.

As described above, the light-emitting module 14 has the light-emitting element 20 as the light source and the control circuit unit 42 controlling the lighting of the light-emitting element 20 integrally structured together. Thus incorporation of the light-emitting module 14 into the automotive headlamp 10 realizes a simultaneous installation of the light-emitting element 20 and the control circuit unit 42 in the automotive headlamp 10. This will reduce the number of processes required for the assembly of the automotive headlamp 10.

Figure 3:
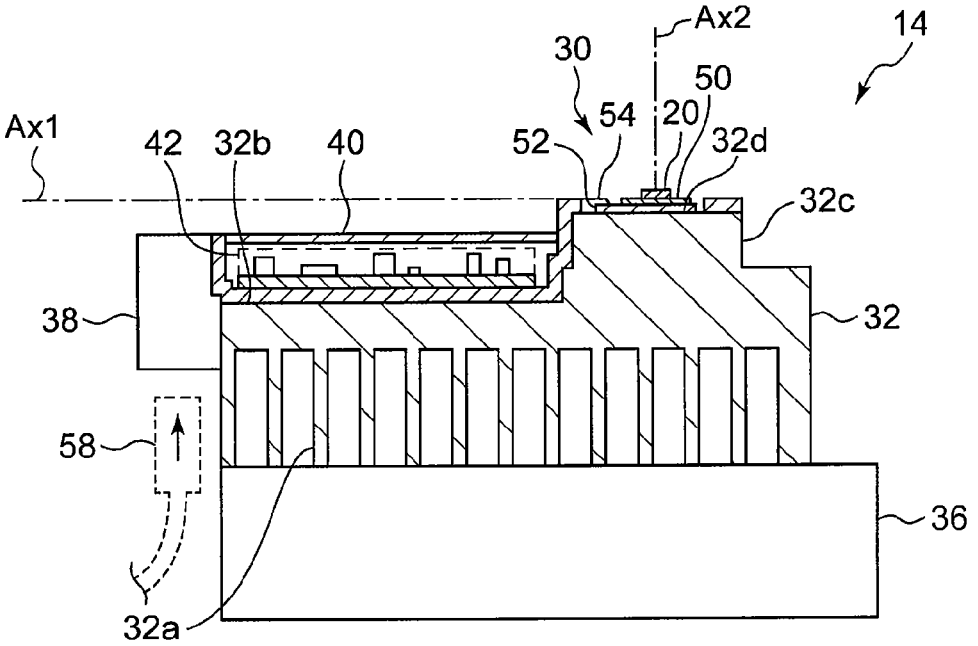
FIG. 3 is a cross-sectional view showing a structure of a light-emitting module.

FIG. 3 is a cross-sectional view showing a structure of the light-emitting module 14. FIG. 3 represents a cross section of the light-emitting module 14 in a plane containing both the optical axis Ax1 of the lamp unit and a main optical axis Ax2. Note that the main optical axis Ax2, as used herein, is the axis passing through the center of the main light-emitting surface, which is the top surface of the light-emitting element 20, perpendicularly thereto.

The package 30 includes a light-emitting element 20, a submounting board 50, and a mounting board 52. The light-emitting element 20 is mounted to the submounting board 50, and the submounting board 50 is mounted to the mounting board 52. The mounting board 52 is provided with a conductive member (not shown) for power feeding.

The attachment 34 has a conductive member 54 integrally molded therewith. The conductive member 54 is connected to the control circuit unit 42 by wire bonding or the like. As the attachment 34 is mounted on the heatsink 32, the conductive member 54 comes in contact with the above-mentioned conductive member of the mounting board 52, thereby establishing an electrical continuity between the package 30 and the control circuit unit 42. Thus the package 30 and the control circuit unit 42 can be electrically connected to each other quite easily.

The control circuit unit 42 is disposed in a position anterior to the light-emitting element 20 in the lamp unit. In this setting, the control circuit unit 42 in a position anterior to the light-emitting element 20 in the lamp unit is so disposed as to be clear of the path of light used to form a light distribution pattern in all the light emitted by the light-emitting element 20. More specifically, the control circuit unit 42 is located in a position anterior to the package 30 and below the cover 40 in the lamp unit. The path of light used to form a light distribution pattern is further above the shade section 18*a* of the shade 18 which is placed on the cover 40. Therefore, the control circuit unit 42, which is disposed below the cover 40, is located in a region clear of the path of light used to form a light distribution pattern.

The light-emitting module 14 is disposed such that the main optical axis Ax2 of the light-emitting element 20 is oriented vertically upward. Therefore, the light-emitting module 14 is so oriented that the main optical axis Ax2 of the light-emitting element 20 is perpendicular to the optical axis Ax1 of the automotive headlamp 10. As such, the light can be efficiently cast on the reflector 16. Accordingly, a low-beam light distribution pattern can be formed properly by way of the reflector 16.

Also, the light-emitting element 20 is so disposed that a light-emitting portion thereof protrudes higher than the control circuit unit 42 in the direction of the main optical axis Ax2. The light-emitting portion includes the main light-emitting surface of the light-emitting element 20 and the side portions surrounding the main light-emitting surface. This avoids the location of the control circuit unit 42 in a front position anterior to the light-emitting portion in the lamp unit, thus ridding of the adverse effects on the light distribution pattern of the control circuit unit 42 located in a front position within the lamp unit.

The cover 40 is provided to cover the whole opening above the circuit holding section in order to prevent foreign material from entering the control circuit unit 42. Thus, the cover 40 is so provided as to cover the entirety of the control circuit unit 42. However, the arrangement may be such that the cover 40 covers only a part of the control circuit unit 42.

The shade section 18*a* of the shade 18 is located above the cover 40. Hence, the cover 40 is disposed on a level lower than the position of the light-emitting element 20, so that the top surface of the cover 40 is below the optical axis Ax1 of the lamp unit. In this manner, the light-emitting portion of the light-emitting element 20 is located in a position higher than the control circuit unit 42 and the cover 40, and therefore the heatsink 32 has a portion to hold the package 30 protruding higher than the portion to hold the control circuit unit 42.

In the area anterior to the light-emitting element 20 in the lamp unit, the region above the shade section 18*a* serves as the path of light to form a low-beam distribution pattern. In the first embodiment, the control circuit unit 42 and the fixed connector 38 are located lower than the top surface of the shade section 18*a* in order for the control circuit unit 42 and the fixed connector 38 to be clear of the path of light in the area anterior to the light-emitting element 20 in the lamp unit. As a result, any adverse effects of the shadow and reflected light of the control circuit unit 42 or the fixed connector 38 on the low-beam distribution pattern can be eliminated.

Also, the fixed connector 38 has a connection part for connection of the wire connector 58 in a lower portion thereof to facilitate the connection of the wire connector 58 by moving the wire connector 58 vertically upward in a region clear of the path of light. It should be appreciated, however, that the direction of connection of the wire connector 58 is not limited to the one described above. The wire connector 58 may be connected by moving the wire connector 58 in any other directions approaching the path of light in a region clear of the path of light.

The wire connector 58 is of such structure that a wire is led out from an end thereof opposite to the end to be connected to the fixed connector 38. Accordingly, the wire connector 58 is connected to the fixed connector 38 as the wire connector 58 is moved vertically upward. This allows the wire led out from the wire connector 58 to be located further away from the path of light, thereby minimizing the possibilities of the wire deforming and straying upward causing any adverse effect on the light distribution pattern.

Second Embodiment

Figure 4:
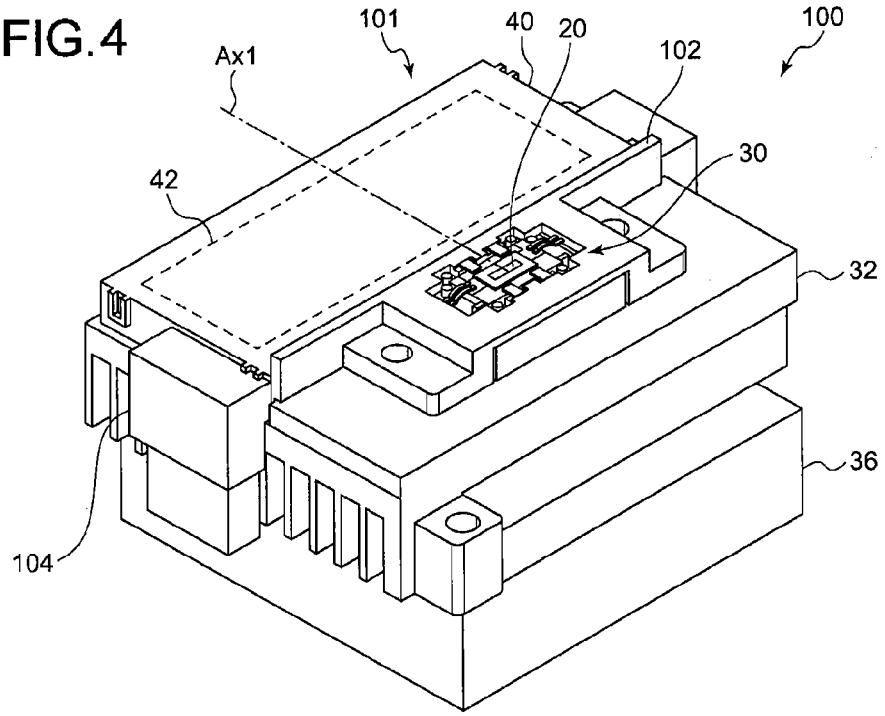
FIG. 4 is a perspective view showing a structure of a light-emitting module according to a second embodiment.

FIG. 4 is a perspective view showing a structure of a light-emitting module 100 according to a second embodiment. The structure of an automotive headlamp according to the second embodiment is the same as that of the automotive headlamp 10 according to the first embodiment except that the light-emitting module 100 is provided in the place of the light-emitting module 14. Note that the same components as those in the first embodiment are hereinbelow denoted with the same reference numerals as those therein, and the description thereof will be omitted.

The light-emitting module 100 is configured similarly to the light-emitting module 14 of the first embodiment except that an attachment 102 is provided in the place of the attachment 34. The attachment 102 is configured similarly to the attachment 34 except that a fixed connector 104 is provided in the place of the fixed connector 38. Thus the attachment 102, the control circuit unit 42, and the cover 40 constitute an attachment unit 101, and this attachment unit 101 is mounted on the heatsink 32.

The fixed connector 104 is provided on each of the left and right side surfaces of the attachment 102. The fixed connector 104 has a connection part for connection of the wire connector in a lower portion thereof to facilitate the connection of the wire connector by moving the wire connector vertically upward in a region lower than the top surface of the shade section 18*a*. Thereby, the wire connector can be clear of the path of light when the wire connector is brought to connect to the fixed connector 104. It should be appreciated, however, that the direction of connection of the wire connector is not limited to the one described above. The wire connector may be connected by moving the wire connector in any other directions approaching the path of light in a region clear of the path of light. Provision of the fixed connectors 104 on the side surfaces of the attachment 102 can further reduce the length of the light-emitting module 100 in the direction of the optical axis Ax1 of the lamp unit.

Third Embodiment

Figure 5:
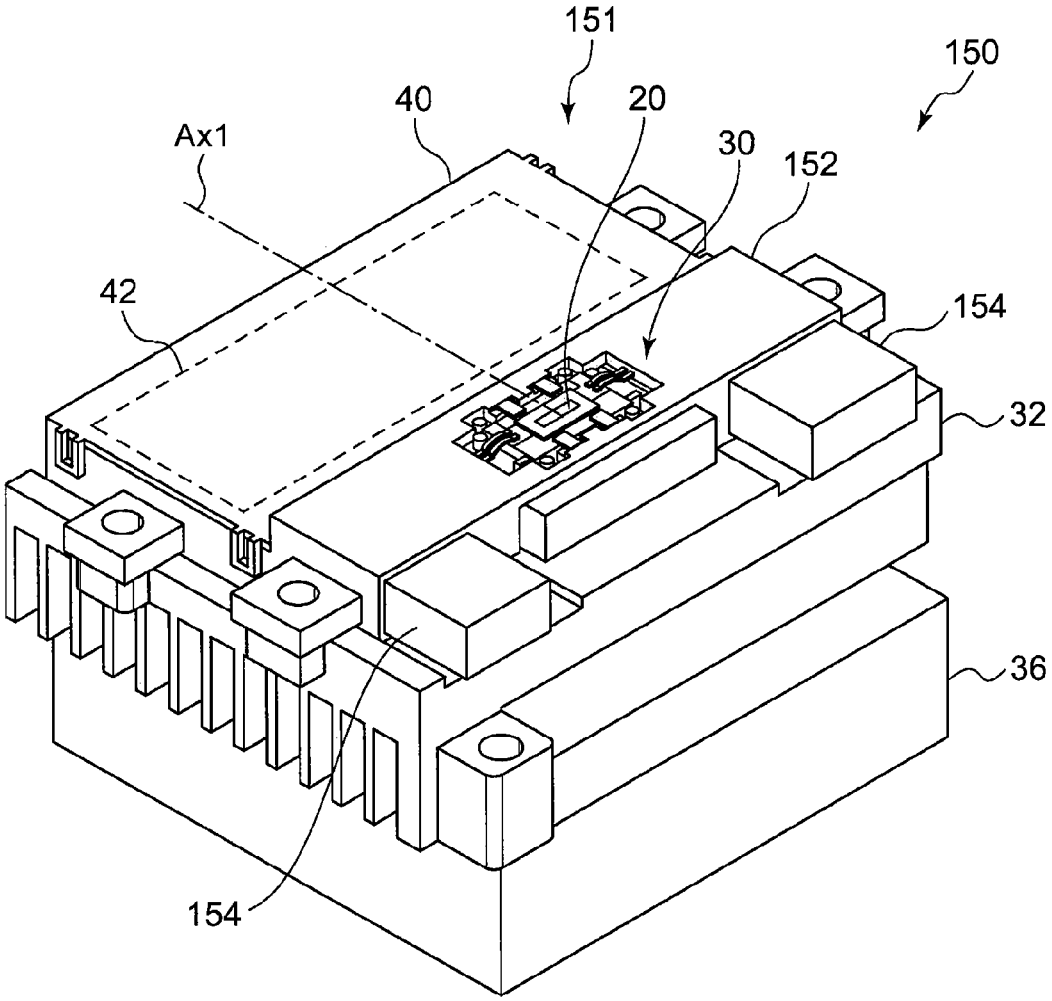
FIG. 5 is a perspective view showing a structure of a light-emitting module according to a third embodiment.

FIG. 5 is a perspective view showing a structure of a light-emitting module 150 according to a third embodiment. The structure of an automotive headlamp according to the third embodiment is the same as that of the automotive headlamp 10 according to the first embodiment except that the light-emitting module 150 is provided in the place of the light-emitting module 14. Note that the same components as those in the above-described embodiments are hereinbelow denoted with the same reference numerals as those therein, and the description thereof will be omitted.

The light-emitting module 150 is configured similarly to the light-emitting module 14 of the first embodiment except that an attachment 152 is provided in the place of the attachment 34. The attachment 152 is configured similarly to the attachment 34 except that a fixed connector 154 is provided in the place of the fixed connector 38. Thus the attachment 152, the control circuit unit 42, and the cover 40 constitute an attachment unit 151, and this attachment unit 151 is mounted on the heatsink 32.

The two fixed connectors 154 are provided on a side surface, which is located rearward in the lamp unit, of the attachment 152. The fixed connector 154 has a connection part for connection of the wire connector in a rearward position in the lamp unit. This connection part in the fixed connector 154 is so provided as to facilitate the connection of the wire connector by moving the wire connector horizontally toward a front area in the lamp unit in a region posterior to the light-emitting element 20 in the lamp unit in order that the wire connector can be clear of the path of light. It should be appreciated, however, that the direction of connection of the wire connector is not limited to the one described above. Provision, in this manner, of not only the control circuit unit 42 in a position anterior to the light-emitting element 20 in the lamp unit but also the fixed connectors 154 on a rear side surface of the attachment 152 can reduce the length of the light-emitting module 150 in the direction of the optical axis Ax1 of the lamp unit. At the same time, the provision thereof achieves a configuration that makes the connection of the wire connector to the fixed connector 154 easier.

Fourth Embodiment

Figure 6:
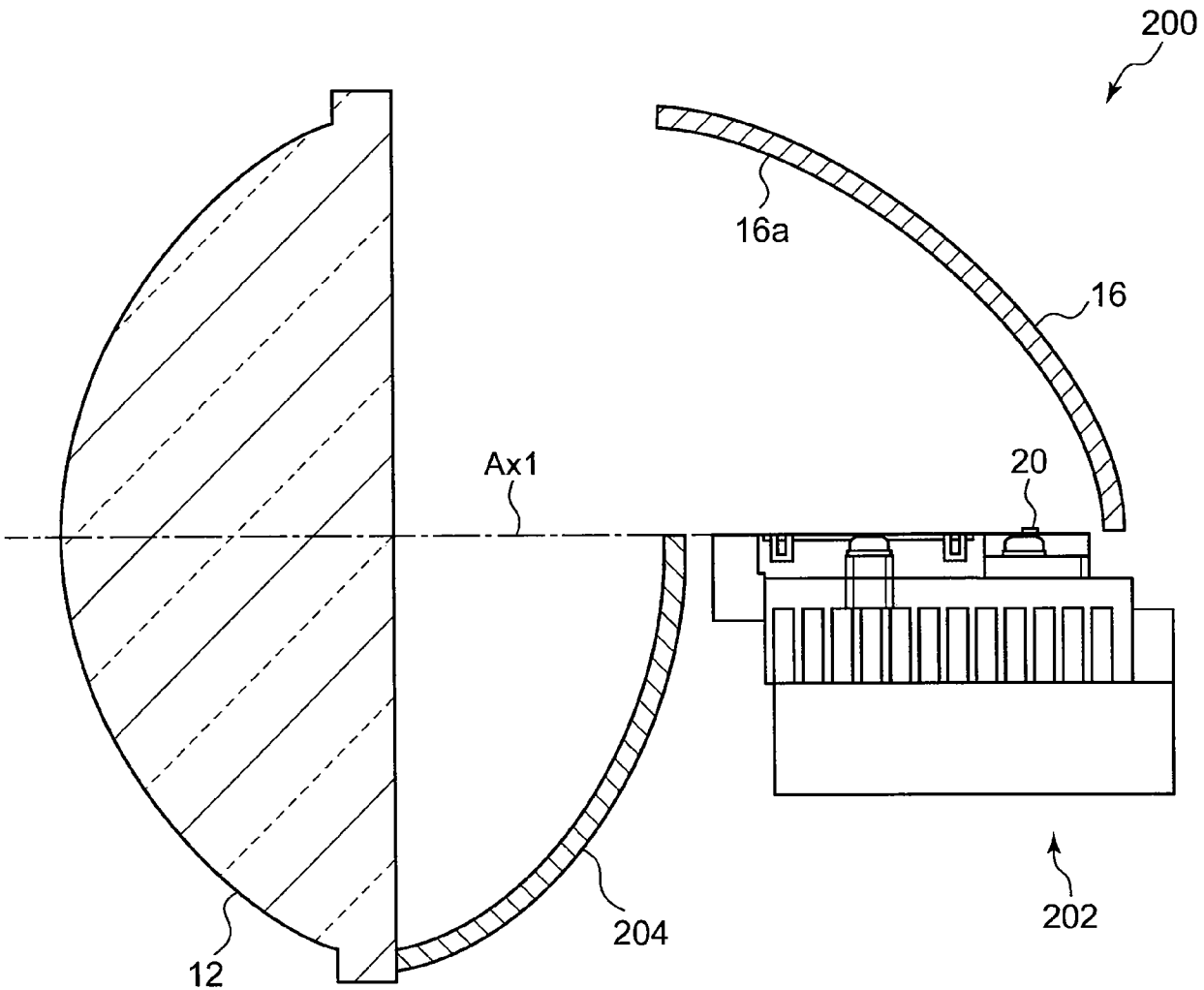
FIG. 6 shows a structure of an automotive headlamp according to a fourth embodiment.

FIG. 6 shows a structure of an automotive headlamp 200 according to a fourth embodiment. FIG. 6 is a vertical cross-sectional view, of the automotive headlamp 200, including the optical axis Ax1 of the lamp unit. The structure of an automotive headlamp according to the fourth embodiment is the same as that of the automotive headlamp 10 according to the first embodiment except that the light-emitting module 202 is provided in the place of the light-emitting module 14 and that a dummy member 204 is provided in the place of the shade 18. Note that the same components as those in the above-described embodiments are hereinbelow denoted with the same reference numerals as those therein, and the description thereof will be omitted.

The dummy member 204 is formed in a shape such that the shade section 18*a* is removed from the shade 18 according to the first embodiment, and the dummy member 204 functions as a design-designated member which constitutes a design surface visible from the outside. A light-emitting module 202 is located in a position posterior to the dummy member 204 in the lamp unit.

Figure 7A:
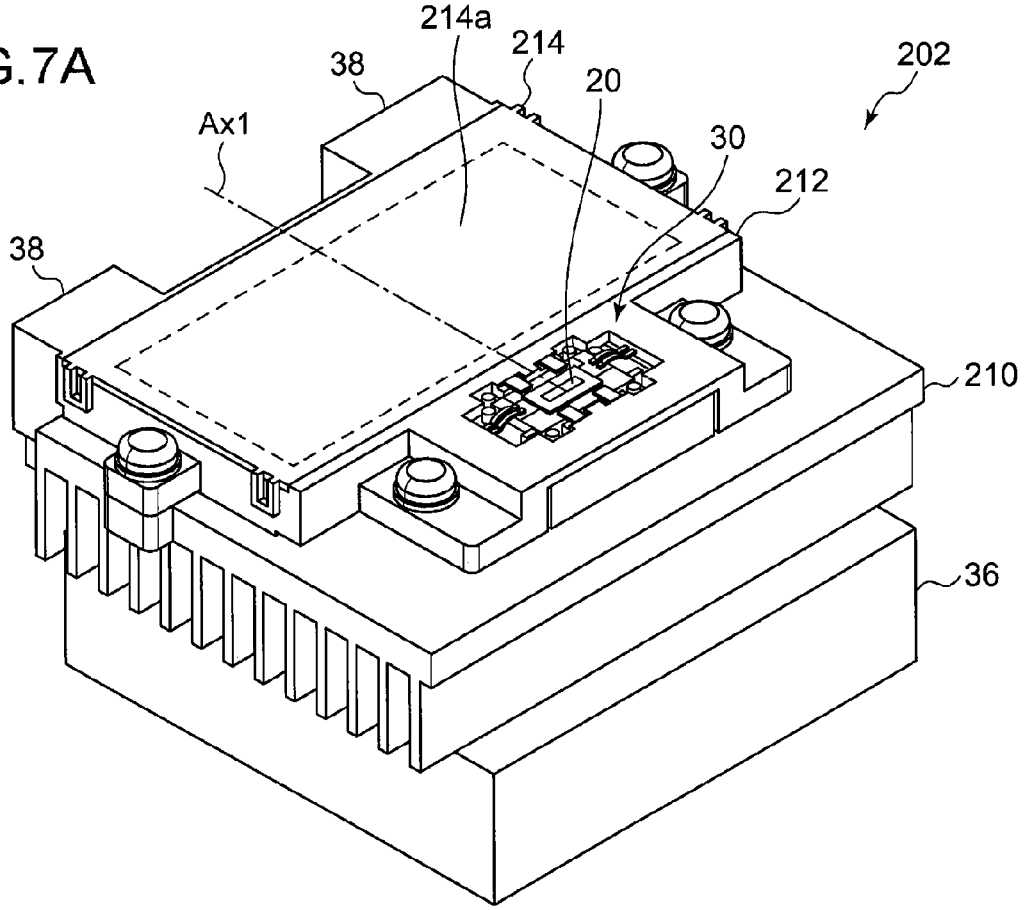
FIG. 7A is a perspective view showing a structure of a light-emitting module according to a fourth embodiment.
Figure 7B:
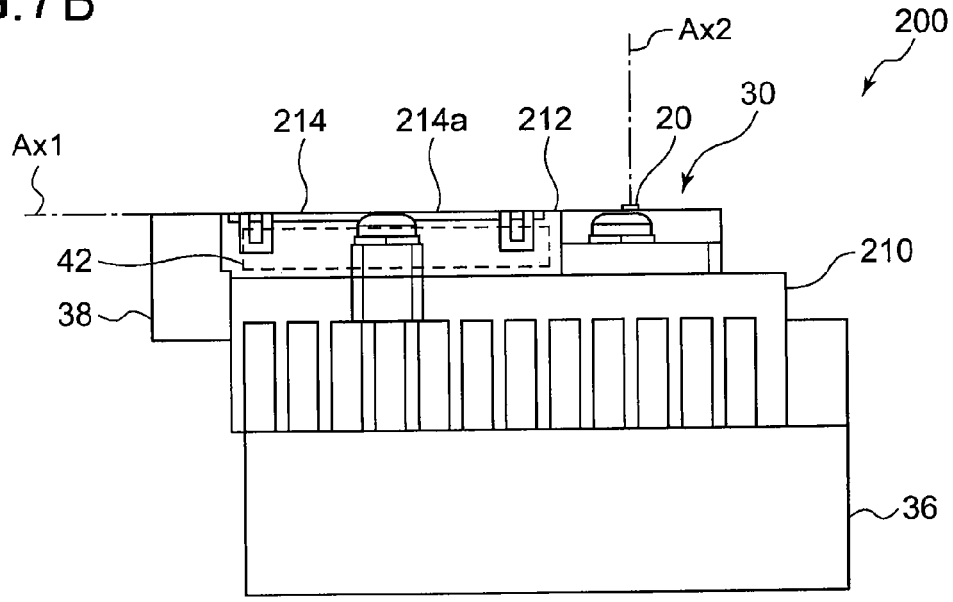
FIG. 7B is a side view of a light-emitting module according to the fourth embodiment.

FIG. 7A is a perspective view showing a structure of the light-emitting module 202 according to the fourth embodiment. FIG. 7B is a side view of the light-emitting module 202 according to the fourth embodiment. The light-emitting module 202 is configured similarly to the light-emitting module 14 of the first embodiment except that a heatsink 210, an attachment 212, and a cover 214 are provided in the place of the heatsink 32, the attachment 34, and the cover 40, respectively.

The heatsink 210 has a portion to hold the package 30 protruding higher than the portion to hold the control circuit unit 42. The level difference between the portion to hold package 30 and the portion to hold the control circuit unit 42 is smaller than that therebetween in the heatsink of the first embodiment.

The attachment 212 has a circuit holding section which is a downward recess to hold the control circuit unit 42. The control circuit unit 42 is held in this circuit holding section. After the control circuit unit 42 is placed therein, the cover 214 is attached to the attachment 212. The cover 214 covers the entire upper side of the control circuit unit 42. Note that the cover 214 may be so provided as to cover at least part of the control circuit unit 42.

The cover 214 has a shade portion 214*a* capable of forming a peripheral or edge part of the light distribution pattern by shielding a part of the light emitted by the light-emitting element 20. In other words, the cover 214 has both the function of preventing foreign material from entering the control circuit unit 42 and the function of defining a cutoff line that is the peripheral part of the low-beam light distribution pattern. As a result, the number of components can be made smaller than when the cover of the control circuit unit and the shade are provided separately. This also makes parts management easier.

Fifth Embodiment

Figure 8:
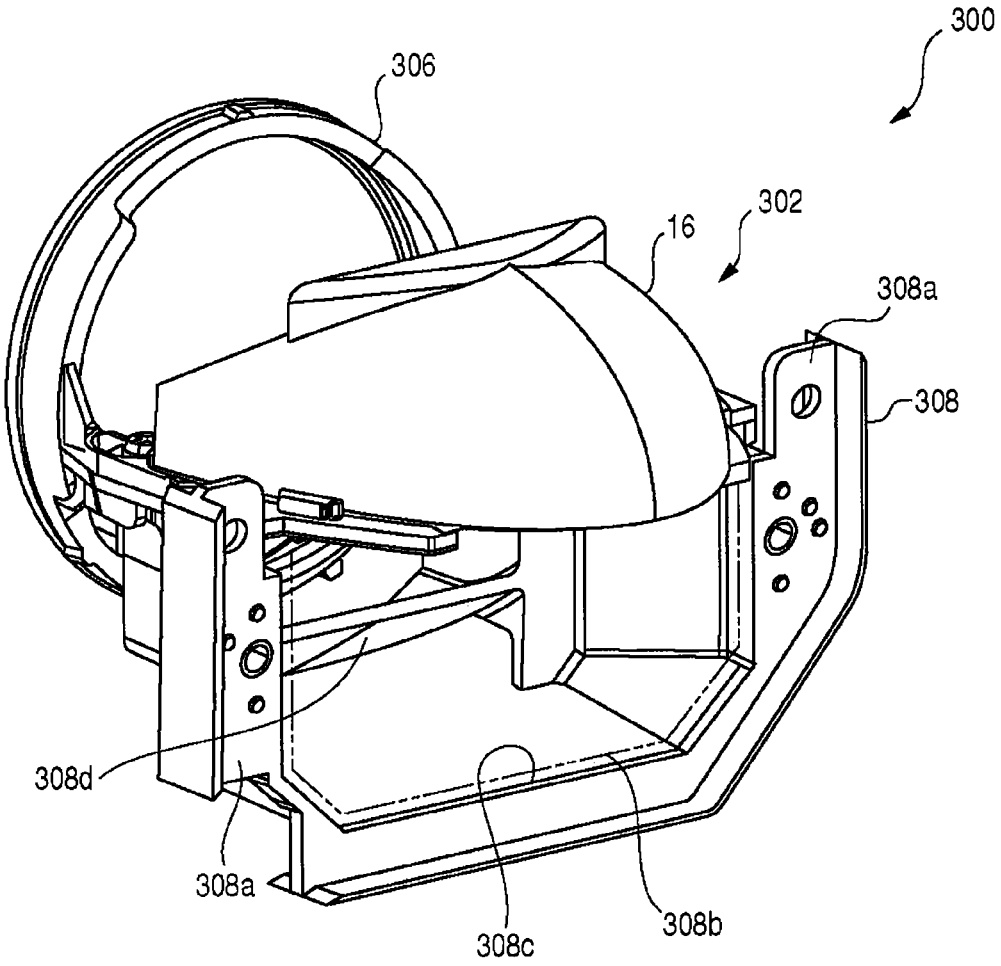
FIG. 8 is a rear perspective view showing a structure of an automotive headlamp according to a fifth embodiment.

FIG. 8 is a rear perspective view showing a structure of an automotive headlamp 300 according to a fifth embodiment. Note that the same components as those in the above-described embodiments are hereinbelow denoted with the same reference numerals as those therein, and the description thereof will be omitted. The automotive headlamp 300 has a main body unit 302. A light-emitting module and the above-described projection lens 12 (not shown) are mounted on the main body unit 302.

The main body unit 302 has a reflector 16, a lens holder 306, and a support member 308. The lens holder 306, which is formed in a ring shape, is fixed in a manner such that projection lens 12 is fit into the lens holder 306. The reflector 16 is fixed to the upper surface of the lens holder 306 and is supported by the support member 308.

The support member 308 is comprised of a securing section 308*a*, a holding section 308*b*, an intake opening 308*c*, and an exhaust duct 308*d*. The control circuit unit for controlling the lighting of the light-emitting element is held within the holding section 308*b* by inserting the control circuit unit into the holding section 308*b*. The light-emitting module is fixed in a manner such that the light-emitting module is abutted against the securing section 308*a* after insertion of the control circuit unit. The intake opening 308*c* is an air inlet of a fan that cools the light-emitting element. In the fifth embodiment, too, the fan blows air to the heatsink, located above the fan, by drawing in air from below. Thus, the intake opening 308*c* is located below the holding section 308*b*. The exhaust duct 308*d* is an exhaust hole of the fan.

Figure 9:
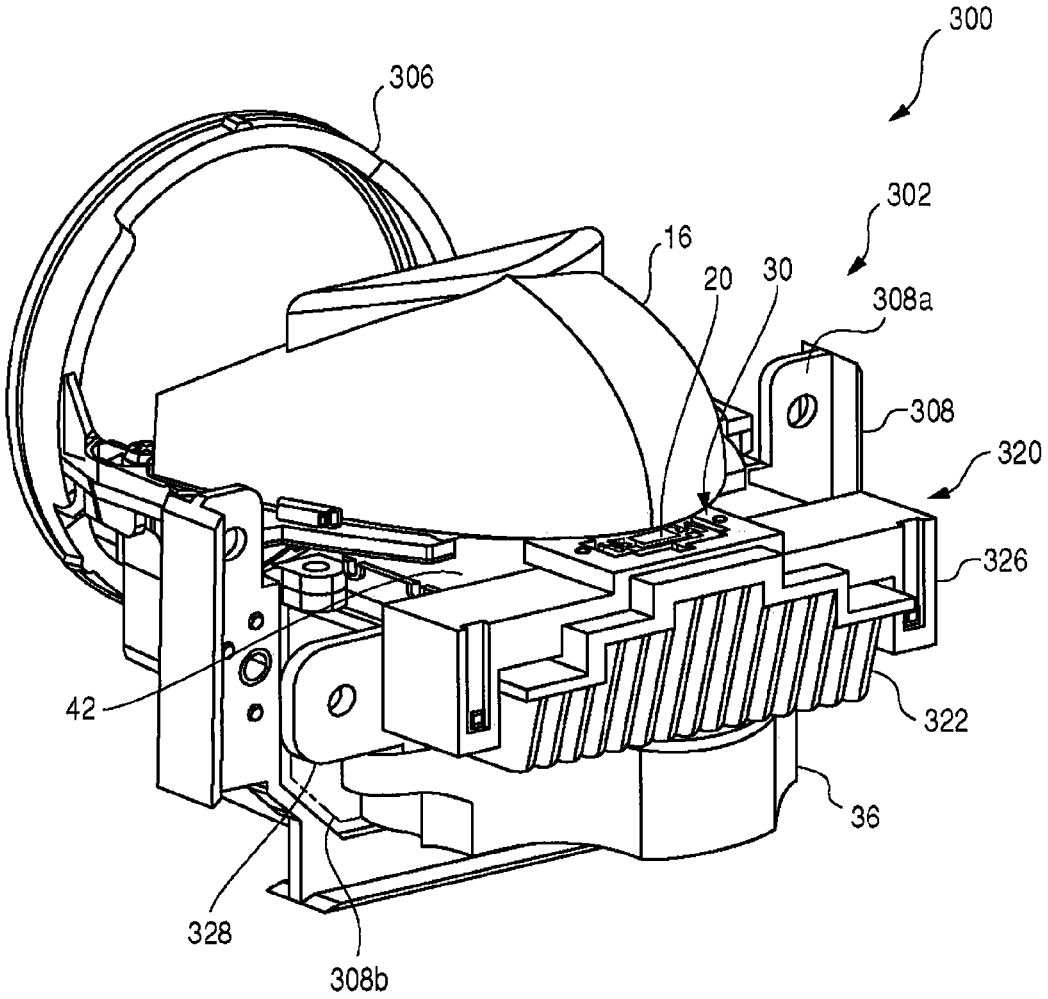
FIG. 9 shows a state where a light-emitting module is inserted into a holding section of a support member.

FIG. 9 shows a state where a light-emitting module 320 is inserted into the holding section 308*b* of the support member 308. The light-emitting module 320 includes a package 30, a control circuit unit 42, a heatsink 322, a connector unit 326, and a fan 36.

The heatsink 322 is made of a highly heat radiant material, such as aluminum. The package 30 is mounted on the top face of the heatsink 322. The heatsink 322 has heat radiation fins that radiate heat generated by the light-emitting element 20 and the control circuit unit 42 of the package 30. The heat radiation fins are provided in a lower part of the heatsink 322. The heat radiation fins are provided in such a manner as to extend in a direction parallel to the optical axis of the lamp unit. The fan 36 is mounted to the heatsink 322 below the heat radiation fins such that the fan 36 can blow air to the heat radiation fins.

In the fifth embodiment, too, the control circuit unit 42 is disposed in a position anterior to the light-emitting element 20 in the lamp unit. For the automotive headlamps mounted on a vehicle, however, it is generally required that the light-emitting module 320 be insertable and removable from a rear area of the lamp unit. Accordingly, in the fifth embodiment, the control circuit unit 42 for controlling the lighting of the light-emitting element is held into the holding section 308*b* by inserting the control circuit unit 42 in an anterior direction of the lamp unit. Thus, the light-emitting module 320 can be attached and detached from the rear area of the lamp.

Figure 10:
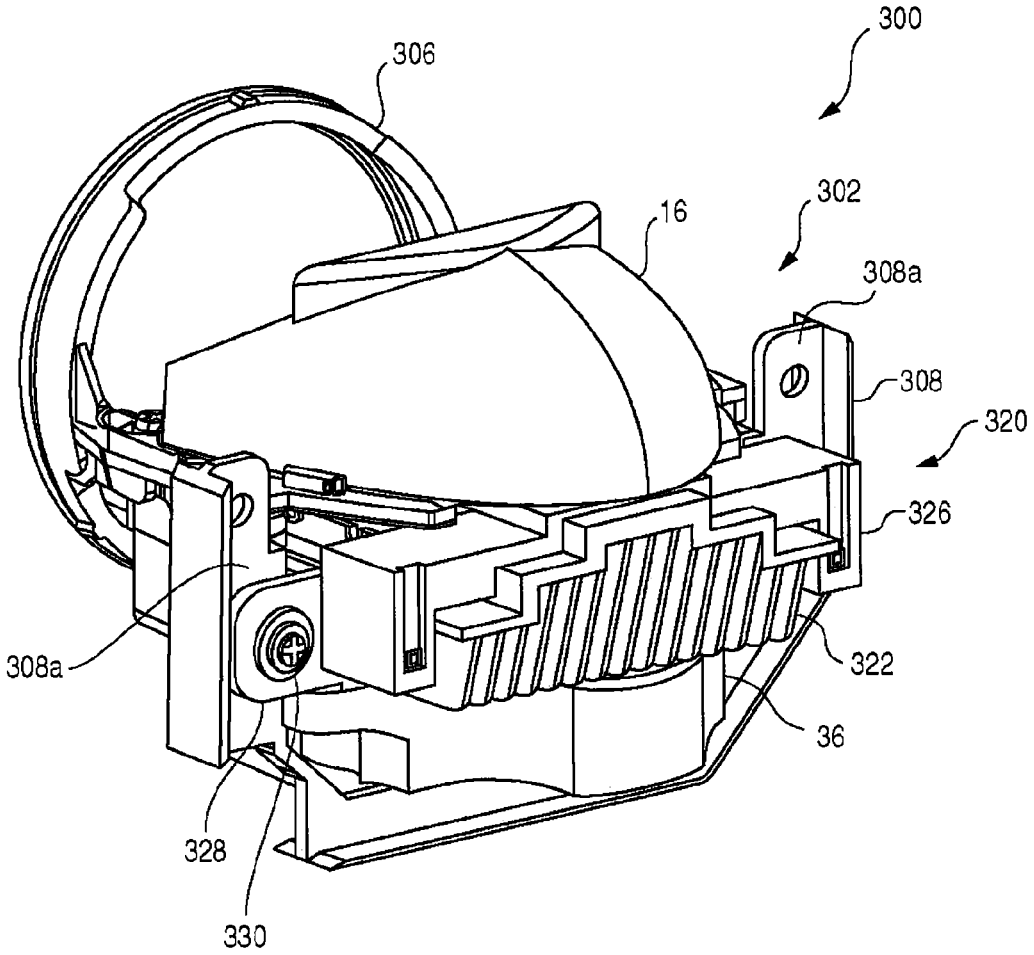
FIG. 10 shows a state where a light-emitting module has been fixed to a securing section of a support member.

FIG. 10 shows a state where the light-emitting module 320 has been fixed to the securing section 308*a* of the support member 308. The light-emitting module 320 is fixed to the securing section 308*a* in a manner such that the light-emitting module 320 abuts an anterior position in the lamp unit after the insertion of the control circuit unit 42 into the holding section 308*b*. More specifically, the light-emitting module 320 has a protrusion 328 protruding laterally therefrom. The protrusion 328 has a round hole. Also, the securing section 308*a* has screw holes. As the protrusion 328 is abutted against the securing section 308*a*, a screw 330 is screwed into the screw hole of the securing section 308*a* passing through the round hole of the protrusion 328. Thereby, the light-emitting module 320 is fixed firmly to the support member 308. Note that any other fastening means may be used in substitution for the screw 330.

As described above, both the direction in which the control circuit unit 42 is inserted and the butting direction at the time of securing the control circuit unit 42 are set to an anterior direction of the lamp unit. Hence, a simple process in which the light-emitting module 320 is moved forward and then secured with the screws 330 when it butts the securing section 308*a* enables the light-emitting module 320 to be secured to the support member 308.

It should be noted that the abutting direction of the light-emitting module 320 is not limited to the anterior direction of the lamp unit. For example, the light-emitting module 320 may be secured by abutting the light emitting module 320 against a position lower than the support member 308. In this case, for example, the light-emitting module 320 can be secured to the support member 308 with screws from above, for instance.

Figure 11:
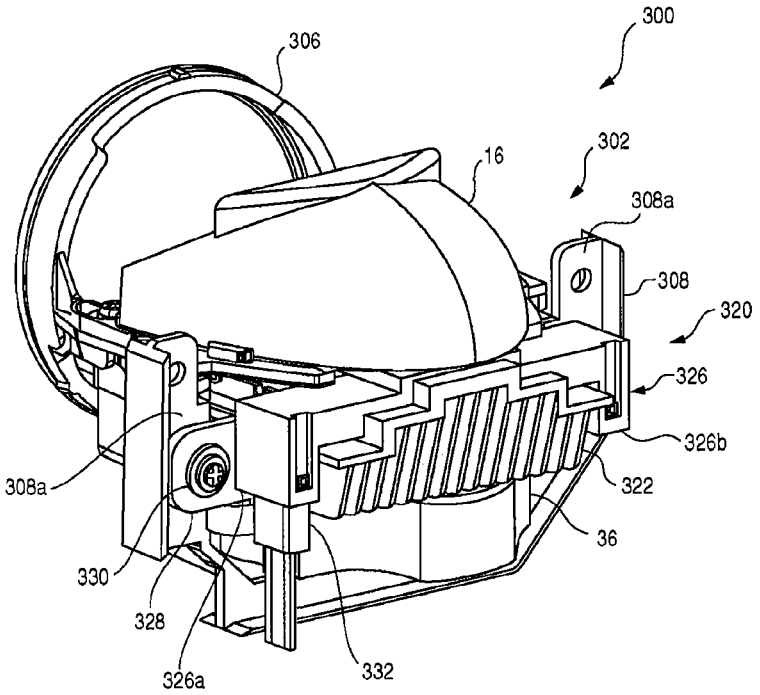
FIG. 11 shows a state where a fan-side connector is mounted on a connector unit.

FIG. 11 shows a state where a fan-side connector 332 is mounted on the connector unit 326. The connector unit 326 has a fan connector 326*a* for use with fan and an input connector 326*b*. The fan connector 326*a* connects the fan 36 to the control circuit unit 42 by connecting the fan-side connector 332, connected to the fan 36, to the fan connector 326*a*. In the fifth embodiment, the control circuit unit 42 has a function of not only controlling the lighting of the light-emitting element 20 but also controlling the drive of the fan 36. As a result, the space for locating the circuit may be reduced as compared with the case where a drive circuit for driving the fan 36 is separately provided.

The vehicle is also provided with an electronic control unit (hereinafter referred to as "ECU") for controlling the lighting of the light-emitting element 20 and the drive of the fan 36. A single output connector for outputting a first control signal used to control the lighting of the light-emitting element 20 and a second control signal used to control the drive of the fan 36 extends from the ECU. This output connector is connected to the input connector 326*b*. Thus, the first control signal and the second control signal are inputted to the input connector 326*b* via the single connector. As a result, the number of connectors used may be reduced as compared with the case where provided are a first connector for the first control signal and a second connector for the second control signal.

Sixth Embodiment

Figure 12:
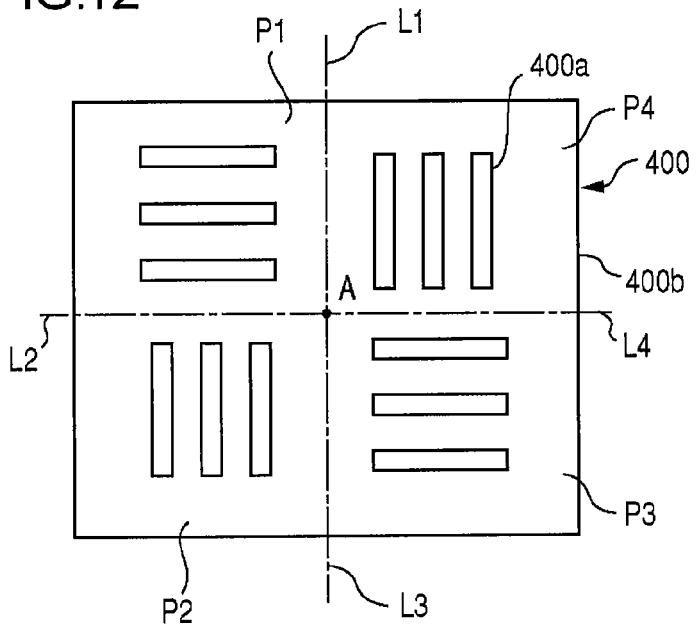
FIG. 12 shows a heatsink according to a sixth embodiment.

FIG. 12 shows a heatsink 400 according to a sixth embodiment. An automotive headlamp according to the sixth embodiment is configured similarly to the automotive headlamps according to the above-described embodiments except that the heatsink 400 is used in the place of the above-described heatsinks.

The heatsink 400 is made of a highly heat radiant material, such as aluminum. The heatsink 400 has heat radiation fins 400*a* that radiate heat generated by the light-emitting element 20 of the package 30 and the control circuit unit 42. The heat radiation fins 400*a* are provided on one surface of a plate 400*b* in a rectangular form. In the sixth embodiment, the heat radiation fins 400*a* are placed in a plurality of portions demarcated by two lines out of a plurality of lines radiated from axis A of the fan 36, respectively, and extend perpendicular to the lines that demarcate the respective particular portions in the plurality of portions.

In the example of FIG. 12, the axis A of the fan 36 is located in the center of the plate 400*b*. The plate 400*b* is demarcated by four lines L1 to L4, which radiate from the axis A, into four portions P1 to P4. As shown in FIG. 12, the lines L1 to L4 extend from the axis A in such a manner that they are perpendicular to each other. The portion P1 is demarcated by the lines L1 and L2 into a rectangular. The portion P2 is demarcated by the lines L2 and L3 into a rectangular. The portion P3 is demarcated by the lines L3 and L4 into a rectangular. The portion P4 is demarcated by the lines L4 and L1 into a rectangular.

The heat radiation fins 400*a* in the portion P1 extend perpendicular to the line L1. The heat radiation fins 400*a* in the portion P2 extend perpendicular to the line L2. The heat radiation fins 400*a* in the portion P3 extend perpendicular to the line L3. The heat radiation fins 400*a* in the portion P4 extend perpendicular to the line L4. In this manner, the heat radiation fins 400*a* in each of the portions P1 to P4 are formed such that the heat radiation fins 400*a* extend perpendicular to each particular line demarcating each portion. The inventors of the present invention found out through their diligent research-and-development activities that such a configuration employed herein has a higher heat release effect than the configuration where the heat radiation fins extend in a single direction, for example. Hence, use of the heatsink 400 according to the sixth embodiment can suitably and efficiently radiate the heat generated by the light-emitting element 20 and/or the control circuit unit 42.

Seventh Embodiment

Figure 13:
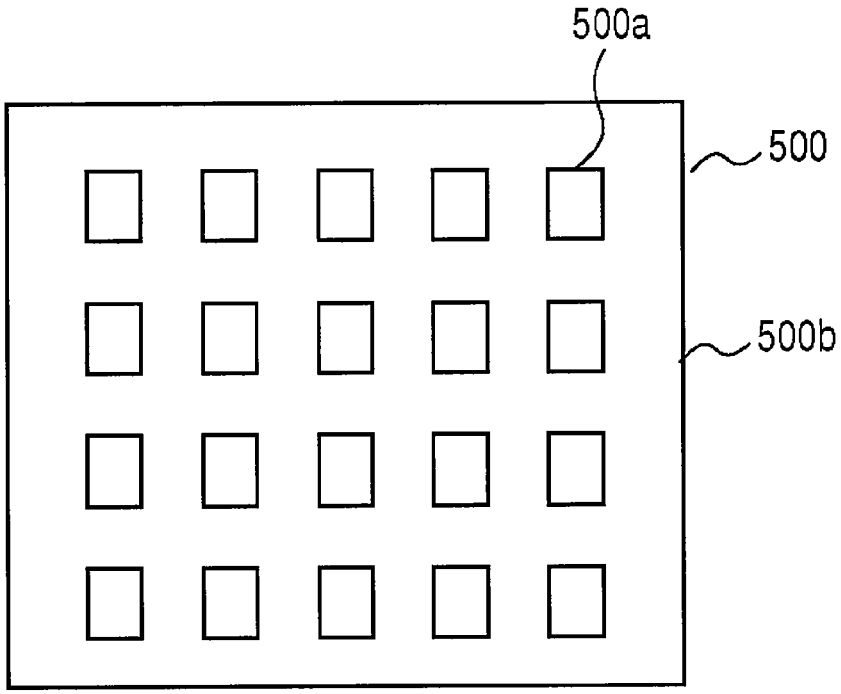
FIG. 13 shows a heatsink according to a seventh embodiment.

FIG. 13 shows a heatsink 500 according to a seventh embodiment. An automotive headlamp according to the seventh embodiment is configured similarly to the automotive headlamps according to the above-described embodiments except that the heatsink 500 is used in the place of the above-described heatsinks.

The heatsink 500 is made of a highly heat radiant material, such as aluminum. The heatsink 500 has heat radiation fins 500*a* that radiate heat generated by the light-emitting element 20 of the package 30 and the control circuit unit 42. The heat radiation fins 500*a* are provided on one surface of a plate 500*b* in a rectangular form.

The heatsink 500 is formed in a rod-like shape extending perpendicularly to one surface of the plate 500*b*. The heat radiation fins 500*a* are arranged such that a plurality of gaps (spacing) are formed in a plurality of directions. In the seventh embodiment, the heat radiation fins 500*a* are arranged such that the plurality of gaps is formed in both the vertical direction and the horizontal direction. If, for example, the heat radiation fins are so formed as to extend in one direction, the gaps between the heat radiation fins will also be formed in one direction only. In contrast to this, if, as described above, the heat radiation fins 500*a* are so formed that a plurality of gaps are formed in a plurality of directions, the flow of air around the heat radiation fins 500*a* can be made smooth. The inventors of the present invention also found out through their diligent research-and-development activities that the configuration, where the heat radiation fins 500*a* are formed as above has a higher heat release effect than the configuration, where the heat radiation fins extend in a single direction, for example. Hence, use of the heatsink 500 according to the seventh embodiment can suitably and efficiently radiate the heat generated by the light-emitting element 20 and/or the control circuit unit 42.

Eighth Embodiment

An eighth embodiment relates to a heat radiation mechanism and a light-emitting apparatus and, in particular, to a heat radiation mechanism for radiating the heat generated by a light source and a control circuit board for controlling the lighting of the light source and a light-emitting apparatus equipped with said heat radiation mechanism.

In the automotive headlamps being used, for example, there are cases where a control circuit for controlling the lighting of the light-emitting elements is provided independently of the mounting substrate to which the light-emitting elements are directly mounted. Since this control circuit provided separately also generates heat, the heat generated thereby needs to be radiated. Heat generated by the light-emitting elements such as LEDs needs to be radiated as well. Besides, if, for example, a heat-dissipating member for the control circuit and that for the light-emitting element are provided in different positions, it will be difficult to reduce the space occupied by these heat-dissipating members. Hence, it is a pressing need to reduce the space occupied by these heat-dissipating members in attempting to downsize the automotive headlamps.

The eighth embodiment is implemented to solve the aforementioned problems, and a purpose thereof is to place a heat-dissipating member for radiating the heat of the light source and a heat-dissipating member for radiating the heat generated by a control circuit for controlling the lighting of the light source in such a manner as to effectively use a limited space.

To resolve the foregoing problems, a heat radiation mechanism according to the eighth embodiment includes a first heat radiation member for radiating heat of a light source and a second heat radiation member for radiating heat generated by a control circuit board that controls the lighting of the light source, the second heat radiation member being placed such that the second heat radiation member overlaps with at least part of the first heat radiation member as viewed from a first direction parallel to the control circuit board. The first heat radiation member is placed such that the first heat radiation member overlaps with at least part of the control circuit board as viewed from a second direction perpendicular to the control circuit board.

According to this embodiment, the first heat radiation member and the second heat radiation member are so arranged that they overlap with each other as viewed from the first direction. Thus, the area of the space occupied by the first heat radiation member and the second radiation member as viewed from the first direction can be reduced. Also, the first heat radiation member is so arranged that the first heat radiation member overlaps with at least part of the control circuit board as viewed from the second direction. Thus, the first heat radiation member is formed in a larger size and overlaps with the control circuit board. As a result, the increase in the area of the space occupied by the first heat radiation member and the second radiation member as viewed from the second direction can be suppressed.

The heat radiation mechanism may further include a heat separation member whose thermal conductivity is lower than that of the first radiation member and that of the second radiation member. The first heat radiation member and the second heat radiation member may be fixed to each other with the heat separation member held between the first heat radiation member and the second heat radiation member. According to this embodiment, the heat transference between the first heat radiation member and the second heat radiation member can be suppressed. Accordingly, the thermal effect of one of the light source and the control circuit unit on the other thereof can be suppressed. To further suppress the thermal effect, the heat separation member may have a slit, the slit being formed such that the area of contact between the first heat radiation member and the second radiation member is smaller.

The second heat radiation member may be formed such that a portion of the second heat radiation member disposed counter to an approximate center of the control circuit board protrudes more in the second direction than a portion thereof disposed counter to a predetermined edge vicinity portion of the control circuit board. Also, the first heat radiation member may be provided such that the first heat radiation member overlaps with the predetermined edge vicinity portion of the control circuit board as viewed from the second direction.

In such a control circuit board as described above, it is generally easy to gather the electronic components mounted on the control circuit board, which produce heat, in the center area. Thus, by employing this embodiment, the heat generated through the board can be efficiently radiated and, at the same time, a space near an edge of the board can be used for the first heat radiation member. Hence, the degradation in the thermal conductivity can be avoided and, at the same time, the space occupied by the first heat radiation member and the second heat radiation member can be reduced.

According to this embodiment, the heat-radiation member for radiating the heat of the light source and the heat radiation member for radiating the heat generated by the control circuit for controlling the lighting of the light source can be placed in such a manner as to effectively use the space.

Figure 14:
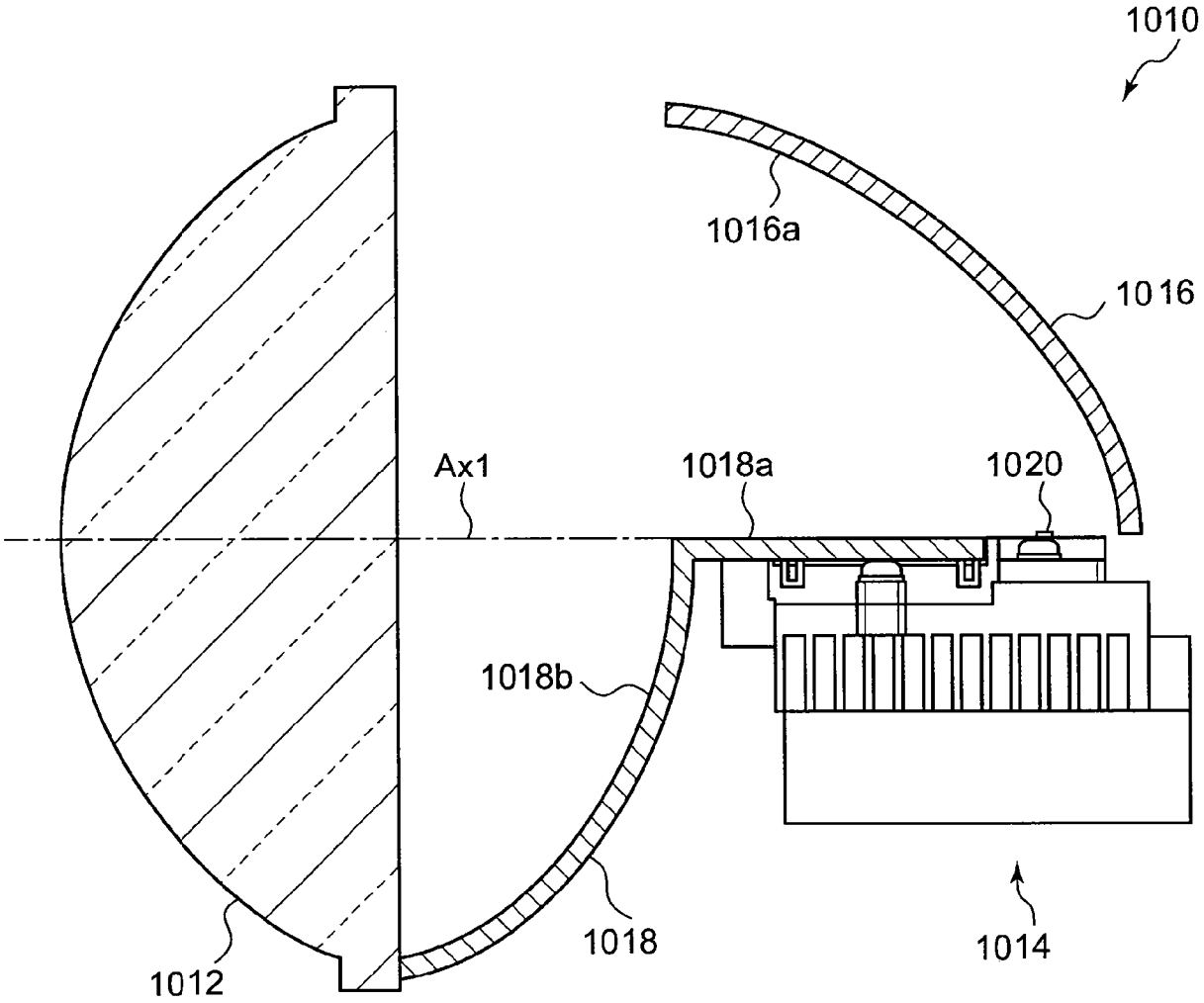
FIG. 14 shows a structure of an automotive headlamp according to an eighth embodiment.

FIG. 14 shows a structure of an automotive headlamp 1010 according to the eighth embodiment. FIG. 14 is a vertical cross-sectional view, of the automotive headlamp 1010, including the optical axis Ax1 of a lamp unit. The automotive headlamp 1010 functions as a so-called low-beam light source that forms a low-beam light distribution pattern. It should be noted that the automotive headlamp 1010 is not limited to that described above and the automotive headlamp 1010 may function as a high-beam light source that forms a high-beam light distribution pattern.

The automotive headlamp 1010 includes a projection lens 1012, a light-emitting module 1014, a reflector 1016, and a shade 1018. The projection lens 1012 is a plano-convex aspheric lens, having a convex front surface and a plane rear surface, which projects a light source image formed on a rear focal plane toward a front area of the lamp unit as a reverted image.

The light-emitting module 1014 has a light-emitting element 1020 constituted by LEDs, which function as a light-emitting apparatus and are semiconductor light-emitting elements. It is to be noted that the light-emitting element 1020 may be constituted by any other light-emitting element other than LEDs, and an electric-discharge lamp, an incandescent lamp, or the like may be used as the light source in the place of the light-emitting element 1020. The light-emitting module 1014 is disposed such that the light-emitting element 1020 emits light mainly upward.

The reflector 1016 has a reflecting surface 1016*a* that reflects and focuses the light emitted by the light-emitting element 1020. The reflector 1016 is disposed such that the reflecting surface 1016*a* is located above and opposite to the light-emitting element 1020. The shade 1018 has a shade section 1018*a* and a joining section 1018*b*. The shade section 1018*a* has a plane containing the optical axis Ax1 of the lamp unit, which defines a cutoff line near the horizontal line of the low-beam light distribution pattern. Note that a description of the shape of the shade section 1018*a*, which is known in the art, is omitted. The joining section 1018*b* joins the projection lens 1012 to the shade section 1018*a*. The joining section 1018*b* also functions as a design-designated member which constitutes a design surface visible from the outside.

Figure 15A:
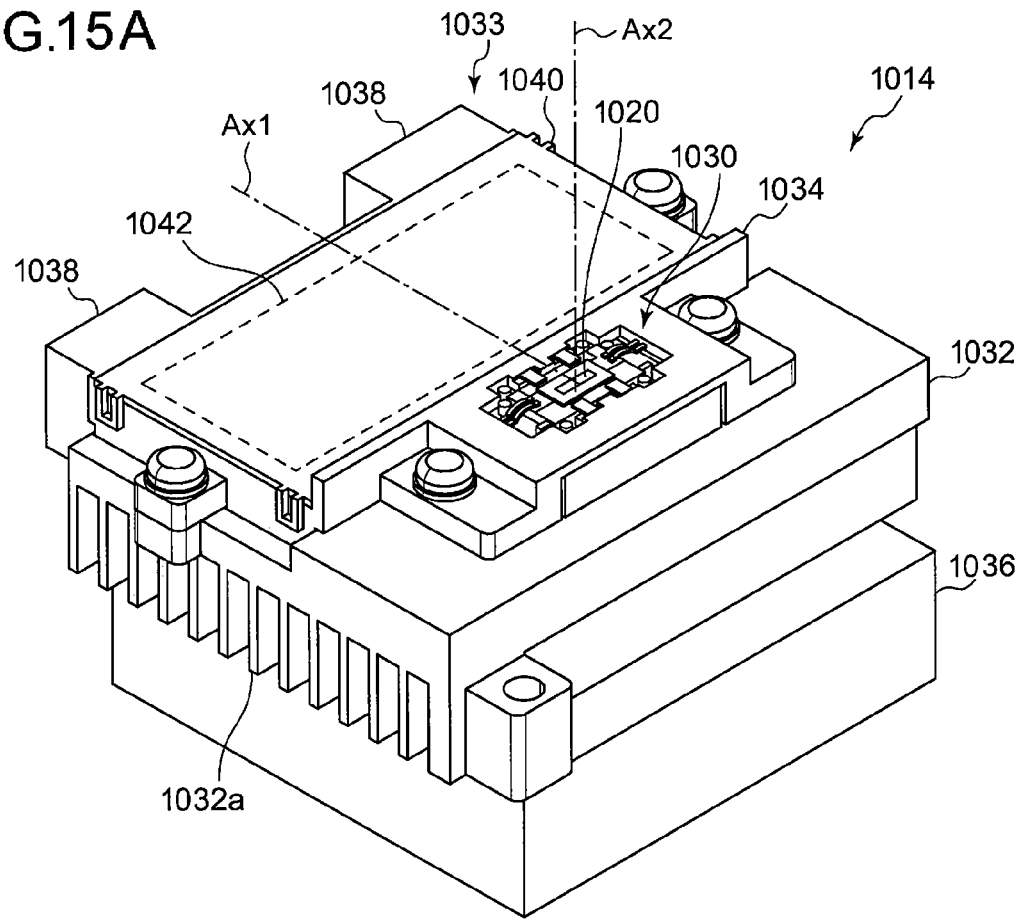
FIG. 15A is a perspective view showing a structure of a light-emitting module according to an eighth embodiment.
Figure 15B:
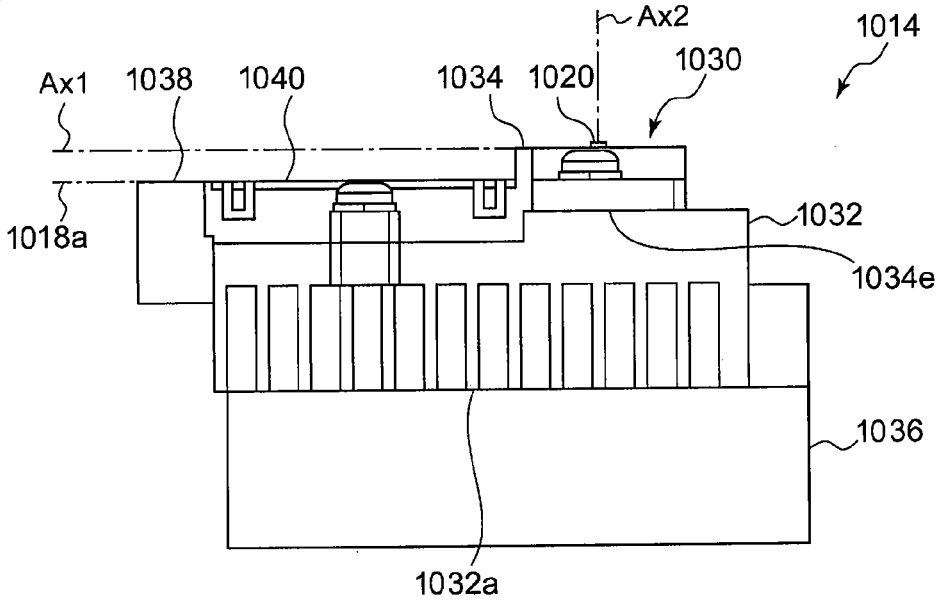
FIG. 15B is a side view of a light-emitting module according to the eighth embodiment.

FIG. 15A is a perspective view showing a structure of a light-emitting module 1014 according to the eighth embodiment. FIG. 15B is a side view of the light-emitting module 1014 according to the eighth embodiment. The light-emitting module 1014 includes a package 1030, a first heatsink 1032, an attachment 1034, a fan 1036, a cover 1040, and a control circuit board 1042.

The package 1030 includes a light-emitting element 1020. The control circuit board 1042 controls the lighting of the light-emitting element 1020. According to this embodiment, the control circuit board 1042 is configured by a printed-circuit board and electrical components and elements mounted on the printed-circuit board.

The first heatsink 1032 is made of a highly heat radiant material, such as aluminum, and functions as a heat radiation member. The first heatsink 1032 has heat radiation fins 1032*a* that radiate heat generated by the light-emitting element 1020 and the control circuit unit 42. The first heatsink 1032 is mounted on a bottom face 1034*e* of the attachment 1034. Thus, the bottom face 1034*e* of the attachment 1034 functions as a heat radiation member mounting section.

The heat radiation fins 1032*a* of the first heatsink 1032 are provided in a lower part of the first heatsink 1032. The heat radiation fins 1032*a* are provided in such a manner as to extend in a direction perpendicular to the optical axis Ax1 of the lamp unit. The fan 1036 is mounted to the first heatsink 1032 below the heat radiation fins 1032*a* such that the fan 1036 can blow air to the heat radiation fins 1032*a*.

The attachment 1034 has a fixed connector 1038 integrally secured thereto by a resin integral molding. The fixed connector 1038 is so provided as to allow connection of a wire connector. The attachment 1034 also has a circuit holding section which is a downward recess to hold the control circuit board 1042. The control circuit board 1042 is held in this circuit holding section. After the control circuit board 1042 is placed therein, the cover 1040 is attached to the attachment 1034. It is also to be noted that the cover 1040 may be excluded. Also, in the place of the cover 1040, the arrangement may be such that a resin molding is applied to the circuit holding section after the placement of the control circuit board 1042 therein.

The control circuit board 1042 is such that the length thereof in the direction perpendicular to the optical axis Ax1 of the lamp unit is greater than the length thereof in the direction parallel thereto. More specifically, the length thereof in the direction perpendicular to the optical axis Ax1 of the lamp unit is more than twice that in the direction parallel thereto. Provision of the control circuit board 1042 in this manner can reduce the length of the light-emitting module 1014 in the direction of the optical axis Ax1 of the lamp unit, thus contributing to the further downsizing of the automotive headlamp 1010.

The attachment 1034, the control circuit board 1042, and the cover 1040 constitute an attachment unit 1033. In the eighth embodiment, the control circuit board 1042 and the cover 1040 are installed in advance on the attachment 1034 before the attachment 1034 is mounted on the heatsink 1032, and the control circuit board 1042 and the cover 1040 are mounted on the heatsink 1032 as the attachment unit 1033. As a result, the attachment 1034 and the control circuit board 1042 are mounted integrally on the heatsink 1032, and at the same time the package 1030 is installed in such a manner as to be held between the attachment 1034 and the first heatsink 1032. Thus, the attachment 1034 functions as a light source fixing member that secures the light-emitting element 1020 to the first heatsink 1032.

As described above, the light-emitting module 1014 has the light-emitting element 1020 as the light source and the control circuit board 1042 controlling the lighting of the light-emitting element 1020 integrally structured together. Thus incorporation of the light-emitting module 1014 into the automotive headlamp 1010 realizes a simultaneous installation of the light-emitting element 1020 and the control circuit board 1042 in the automotive headlamp 1010. This will reduce the number of processes required for the assembly of the automotive headlamp 1010.

The package 1030 includes a light-emitting element 1020, a submounting board, and a mounting board. The light-emitting element 1020 is mounted to the submounting board, and the submounting board is mounted to the mounting board. The mounting board is provided with a conductive member (not shown) for power feeding.

The control circuit board 1042 is disposed in a position anterior to the light-emitting element 1020 in the lamp unit. In this setting, the control circuit board 1042 in a position anterior to the light-emitting element 1020 in the lamp unit is so disposed as to be clear of the path of light used to form a light distribution pattern in all the light emitted by the light-emitting element 1020. More specifically, the control circuit board 1042 is located in a position anterior to the package 1030 and below the cover 1040 in the lamp unit. The path of light used to form a light distribution pattern is further above the shade section 1018*a* of the shade 1018 which is placed on the cover 1040. Therefore, the control circuit board 1042, which is disposed below the cover 1040, is located in a region clear of the path of light used to form a light distribution pattern.

The light-emitting module 1014 is disposed such that the main optical axis Ax2 of the light-emitting element 1020 is oriented vertically upward. Note that the main optical axis Ax2, as used herein, is the axis passing through the center of the main light-emitting surface, which is the top surface of the light-emitting element 1020, perpendicularly thereto. Therefore, the light-emitting module 1014 is so oriented that the main optical axis Ax2 of the light-emitting element 1020 is perpendicular to the optical axis Ax1 of the automotive headlamp 1010. As such, the light can be efficiently cast on the reflector 1016. Accordingly, a low-beam light distribution pattern can be formed properly by way of the reflector 1016.

Also, the light-emitting element 1020 is so disposed that a light-emitting portion thereof protrudes higher than the control circuit unit 1042 in the direction of the main optical axis Ax2. The light-emitting portion includes the main light-emitting surface of the light-emitting element 1020 and the side portions surrounding the main light-emitting surface. This avoids the location of the control circuit unit 1042 in a front position anterior to the light-emitting portion in the lamp unit, thus ridding of the adverse effects on the light distribution pattern of the control circuit unit 1042 located in a front position within the lamp unit.

The cover 1040 is provided to cover the whole opening above the circuit holding section in order to prevent foreign material from entering the control circuit board 1042. Thus, the cover 1040 is so provided as to cover the entirety of the control circuit board 1042. However, the arrangement may be such that the cover 1040 covers only a part of the control circuit board 1042.

The fixed connector 1038 has a connection part for connection of the wire connector 58 (See FIG. 3) in a lower portion thereof to facilitate the connection of the wire connector 58 by moving the wire connector 58 vertically upward in a region clear of the path of light. It should be appreciated, however, that the direction of connection of the wire connector 58 is not limited to the one described above. The wire connector 58 may be connected by moving the wire connector 58 in any other directions approaching the path of light in a region clear of the path of light.

The wire connector 58 is of such structure that a wire is led out from an end thereof opposite to the end to be connected to the fixed connector 1038. Accordingly, the wire connector 58 is connected to the fixed connector 1038 as the wire connector 58 is moved vertically upward. This allows the wire led out from the wire connector 58 to be located further away from the path of light, thereby minimizing the possibilities of the wire deforming and straying upward causing any adverse effect on the light distribution pattern.

Figure 16:
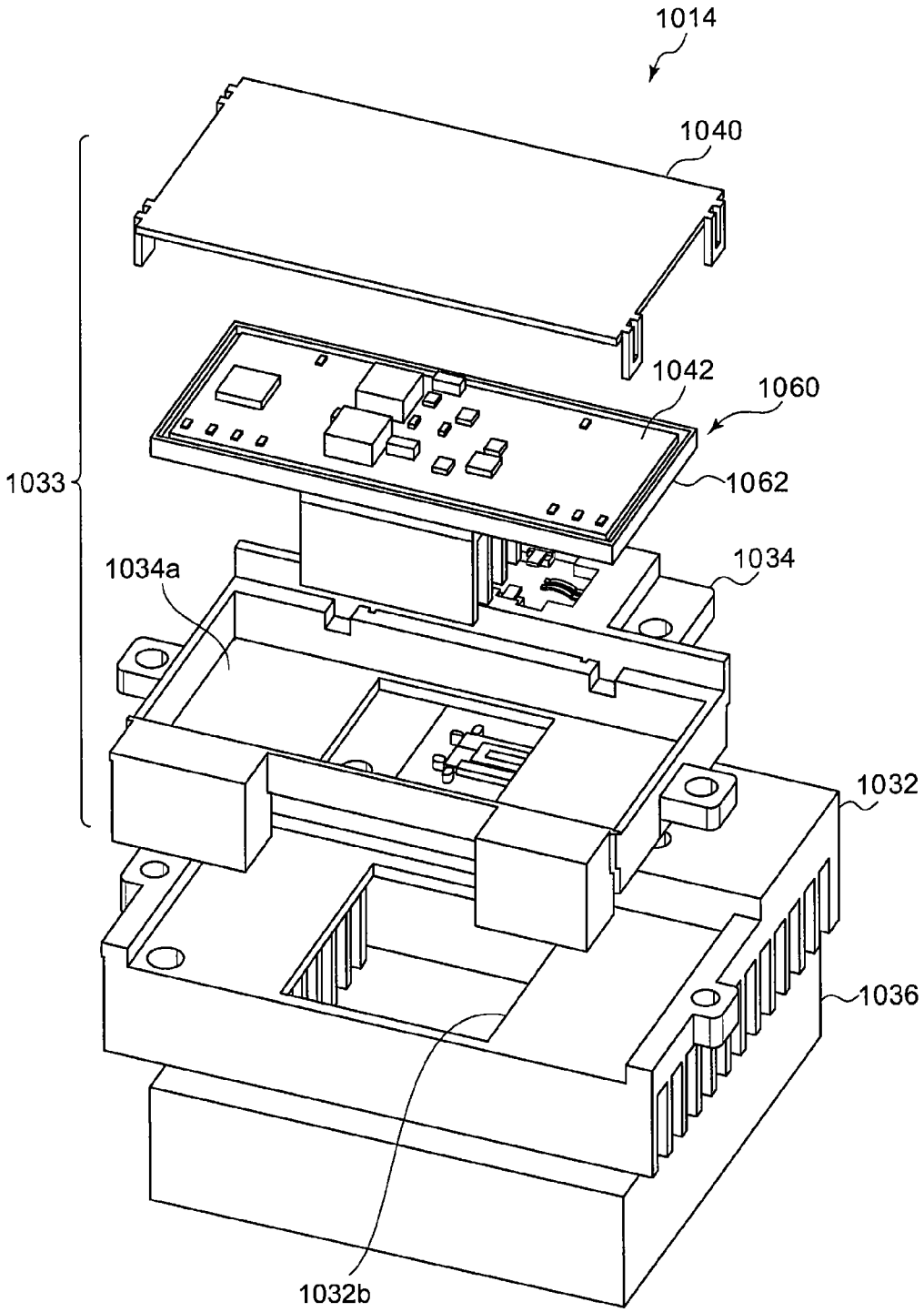
FIG. 16 is a perspective view showing a method for assembling a light-emitting module according to an eighth embodiment.

FIG. 16 is a perspective view showing a method for assembling a light-emitting module 1014 according to the eighth embodiment. The attachment unit 1033 is further constituted by a second heatsink 1062. The second heatsink 1062 has a circuit laying surface 1062*c* (See FIG. 21B) on which a circuit is to be placed. The control circuit board 1042 for controlling the lighting of the light-emitting element 1020 is mounted on this circuit laying surface 1062*c*. The second heatsink 1062 functions as a heat radiation member with which the heat generated by the control circuit board 1042 is radiated. Thus, the first heatsink 1032 and the second heatsink 1062 function as a heat radiation mechanism for radiating the heat generated by the light-emitting element 1020 and the control circuit board 1042.

The control circuit board 1042 is first mounted to the second heatsink 1062 so as to constitute a circuit unit 1060. Then the circuit unit 1060 is secured to the attachment 1034. After the circuit unit 1060 has been secured to the attachment 1034, the control circuit board 1042 and a conductive member provided in the attachment 1034 are connected together by wire bonding or the like. After this, resin is filled onto the circuit for the purpose of the sealing. Finally, the cover 1040 is mounted to the attachment 1043, thereby completing the assembly of the attachment unit 1033.

Figure 17:
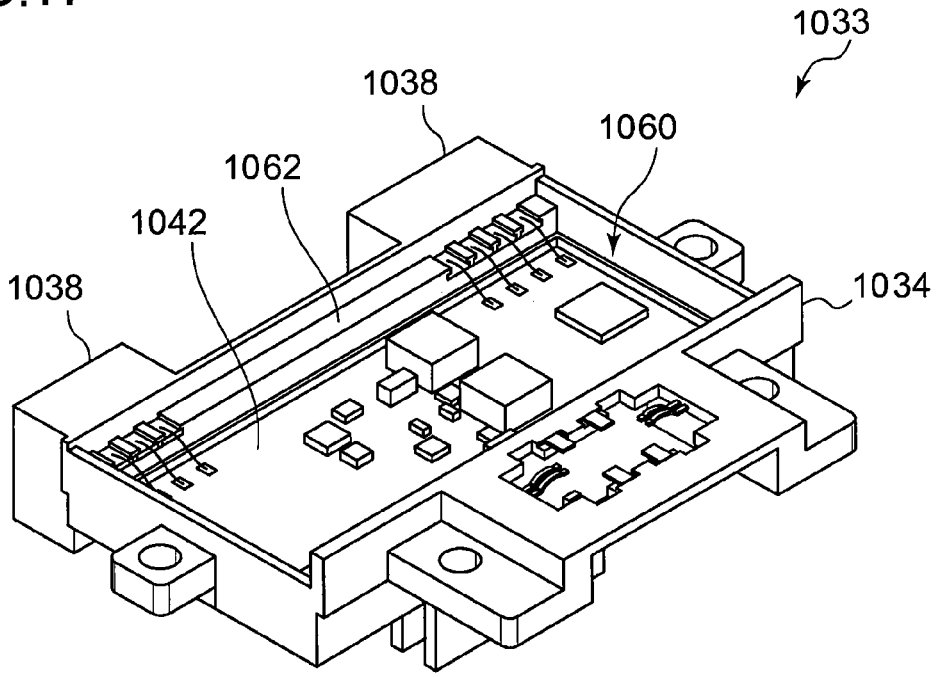
FIG. 17 is a perspective view of an attachment unit according to an eighth embodiment.

FIG. 17 is a perspective view of the attachment unit 1033 according to the eighth embodiment. In this manner, the attachment unit 1033 is configured such that the circuit unit 1060 configured by placing the control circuit board 1042 on the second heatsink 1062 is mounted to the attachment 1034.

Figure 18B:
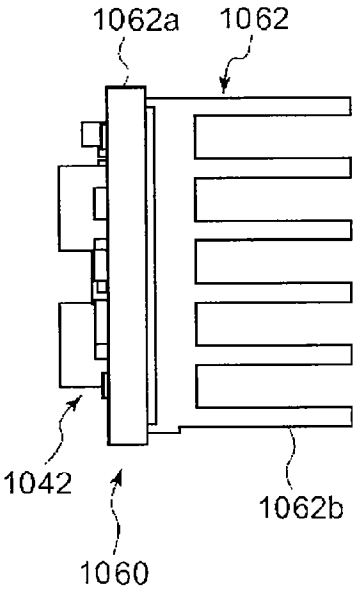
FIG. 18B is a right side view of a circuit unit.
Figure 18A:
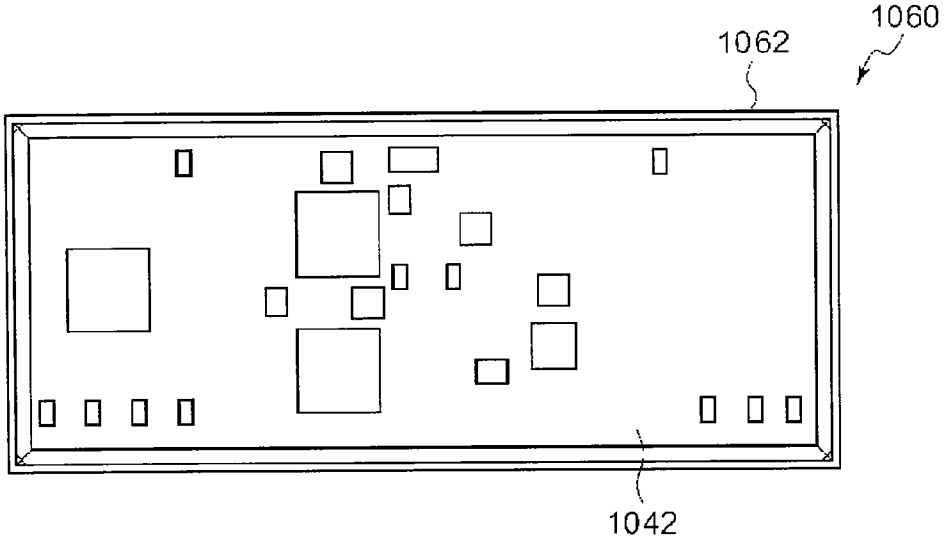
FIG. 18A is a top view of a circuit unit.
Figure 18C:
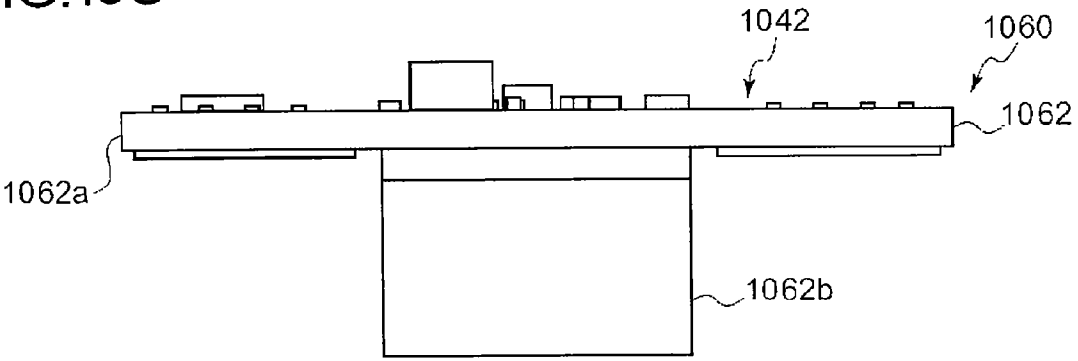
FIG. 18C is a front view of a circuit unit.

FIG. 18A is a top view of the circuit unit 1060. FIG. 18B is a right side view of the circuit unit 1060. FIG. 18C is a front view of the circuit unit 1060. The second heatsink 1062 has a circuit support section 1062*a* and heat radiation fins 1062*b*. The circuit support section 1062*a* is formed in the shape of a flat plate whose size is approximately identical to that of the control circuit board 1042. The control circuit board 1042 is mounted on the circuit laying surface which is the top face of the second heatsink 1062.

The heat radiation fins 1062*b* are formed such that the heat radiation fins 1062*b* extend downward from the bottom face of the circuit support section 1062*a*. The second heatsink 1062 is formed such that a portion of the second heatsink 1062 disposed counter to an approximately center of the control circuit board 1042 protrudes further downward than portions thereof disposed counter to a vicinity of both ends of the control circuit board 1042. More specifically, the heat radiation fins 1062*b* of the second heatsink 1062 are provided in only the portion thereof disposed counter to the approximately center of the control circuit board 1042.

As shown in FIG. 18A, the main components that produce heat are mounted in the center area of the control circuit board 1042. Thus, the heat generated by the control circuit board 1042 can be efficiently radiated by using the heat radiation fins 1062*b* provided counter to a part of the control circuit board 1042.

Figure 19:
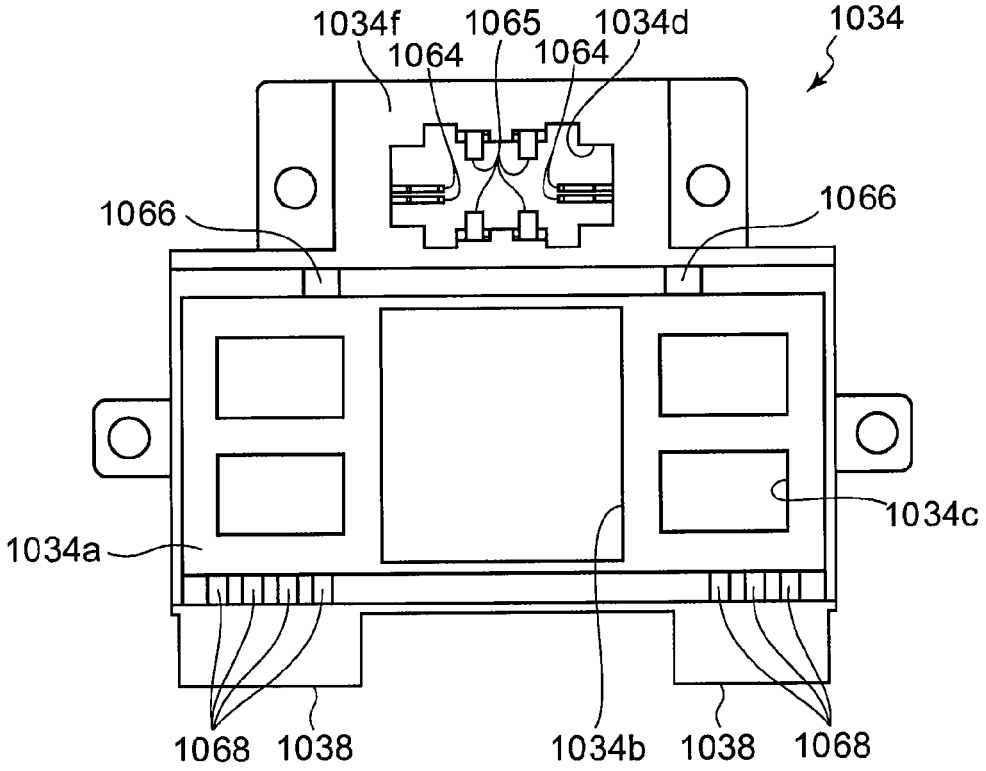
FIG. 19 is a top view of an attachment.

FIG. 19 is a top view of the attachment 1034. The attachment 1034 includes a circuit holding section 1034*a*, fin insertion holes 1034*b*, slits 1034*c*, an opening 1034*d*, and a package securing section 1034*f*.

The control circuit board 1042 for controlling the lighting of the light-emitting element 1020 is mounted to the circuit holding section 1034*a*. Thus the circuit holding section 1034*a* functions as a circuit mounting section. The circuit holding section 1034*a* is a downward recess, and the circuit unit 1060 is secured to the circuit holding section by abutting against the bottom face of the circuit holding section 1034*a*. In order that the area of contact between the first heatsink 1032 and the second heatsink 1062 can be made small, the slits 1034*c* are formed on the bottom of the circuit holding section 1034*a*.

The first heatsink 1032 is mounted on the bottom face 1034*e* of the attachment 1034, so that the package securing section 1034*f* holds the package 1030 between the first heatsink 1032 and the package securing section 1034*f* and thereby secures the package 1030. As a result, the light-emitting element 1020 is secured.

The package securing section 1034*f* has an opening 1034*d*, conductive members 1064, and plate springs 1065. The opening 1034*d* allows the light-emitting element 1020 to pass through from below and is formed such that the light-emitting element 1020 protrudes higher than the top face of the attachment 1034. The conductive member 1064 is so formed as to protrude toward the inside of the opening 1034*d*. The conductive member 1064 is so provided that when the first heatsink 1032 is mounted on the bottom face 1034*e* of the attachment 1034, the conductive member 1064 comes in contact with the electrodes of the light-emitting element 1020 and thereby conducts electricity between the control circuit board 1042 and the light-emitting element 1020. When the attachment 1034 is mounted to the first heatsink 1032, the plate spring 1065 presses the package 1030 against the first heatsink 1032 so as to secure the package 1030 thereto. Thus the plate springs 1065 function as the pressing members that press the package 1030.

In the attachment 1034, the conductive members 1064 are led up to connectors 1066 of the control circuit board 1042, respectively. Thus a part of the attachment 1034 between the package securing section 1034*f* and the connectors 1066 function as a wiring section (space) used to lead and wire the conductive members 1064. The connectors 1066 and the control circuit board 1042 are connected together by wire bonding, whereas the conductive members 1064 are connected to the control circuit board 1042. The conductive members 1064, except for portions of the conductive members 1064 protruding from the opening 1034*d* and those exposed to the connectors 1066, are molded integrally with the attachment 1034.

The attachment 1034 has conductive members 1068. The conductive member 1068 is connected to a connection pin of the fixed connector 1038. The conductive members 1068 and the connection pins are formed integrally with each other. Also, the conductive members 1068 and the attachment 1034 are molded integrally with each other.

The control circuit board 1042, the connectors 1066, and the conductive members 1068 are connected together by wire bonding after the control circuit board 1042 has been mounted to the circuit holding section 1034*a*. As a result, the control circuit board 1042 and the light-emitting element 1020 are electrically connected to each other and the control circuit board 1042 and the connection pins of the fixed connectors 1038 are electrically connected to each other.

Figure 20C:
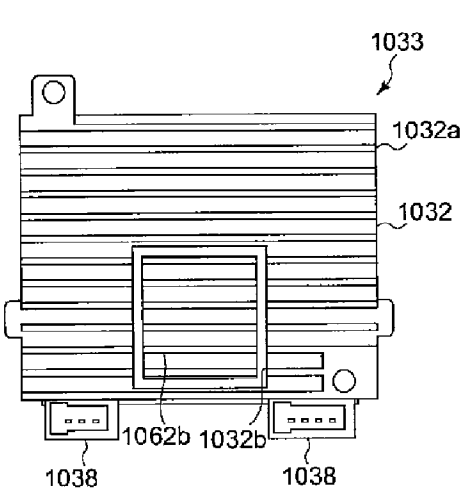
FIG. 20C is a bottom view of an attachment unit.
Figure 20B:
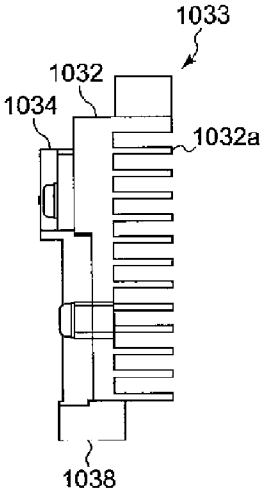
FIG. 20B is a right side view of an attachment unit.
Figure 20:
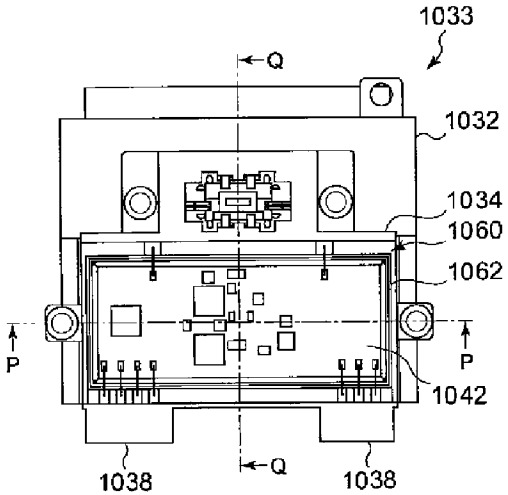
FIG. 20A is a top view of an attachment unit.

FIG. 20A is a top view of the attachment unit 1033. FIG. 20B is a right side view of the attachment unit 1033. FIG. 20C is a bottom view of the attachment unit 1033. Note that the fan 1036 is omitted in FIGS. 20A to 20C.

As shown in FIGS. 20B and 20C, the heat radiation fins 1032*a* are provided in a lower part of the first heatsink 1032, and the heat radiation fins 1062*b* are provided in a lower part of the second heatsink 1062. As shown in FIG. 20C, the first heatsink 1032 has an opening 1032*b* through which the heat radiation fins 1062*b* of the second heatsink 1062 are inserted. The heat radiation fins 1062*b* are inserted through this opening 1032*b*.

The heat radiation fins 1032*a* of the first heatsink 1032 and the heat radiation fins 1062*b* of the second heatsink 1062 are provided in such a manner as to extend in parallel with a direction perpendicular to the optical axis Ax1 of the lamp unit. The fan 1036 is mounted to the first heatsink 1032 below the heat radiation fins 1032*a* and the heat radiation fins 1062*b* such that the fan 1036 can blow air to the heat radiation fins 1032*a* and the heat radiation fins 1062*b*.

The heat radiation fins 1062*b* of the second heatsink 1062 are disposed such that each heat radiation fin 1062*b* extends along the same straight line as the heat radiation fin 1032*a*. Thereby, the space between the heat radiation fins 1062*b* can continue linearly beyond the space between the heat radiation fins 1032*a* and therefore air can smoothly flow therethrough.

Figure 21A:
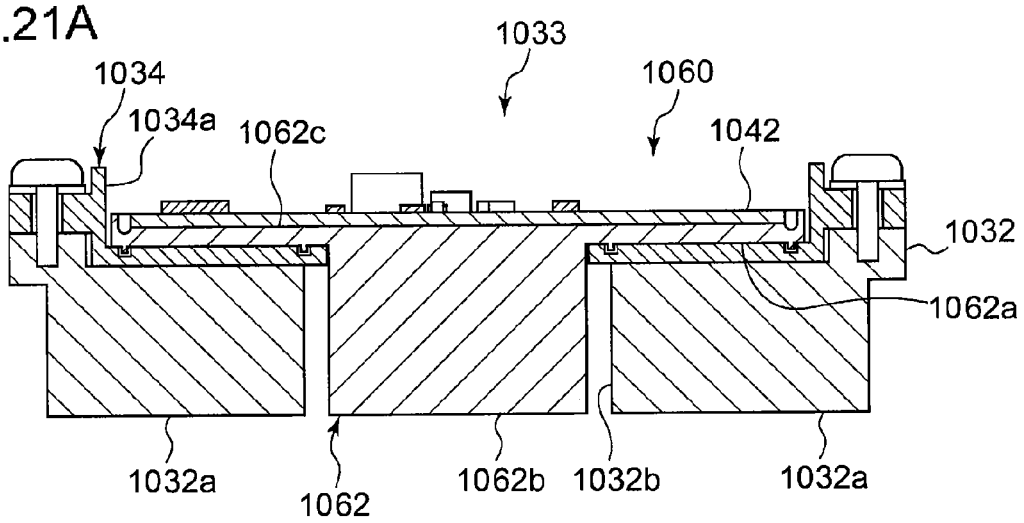
FIG. 21A is a cross-sectional view of FIG. 20A taken along the line P-P.
Figure 21B:
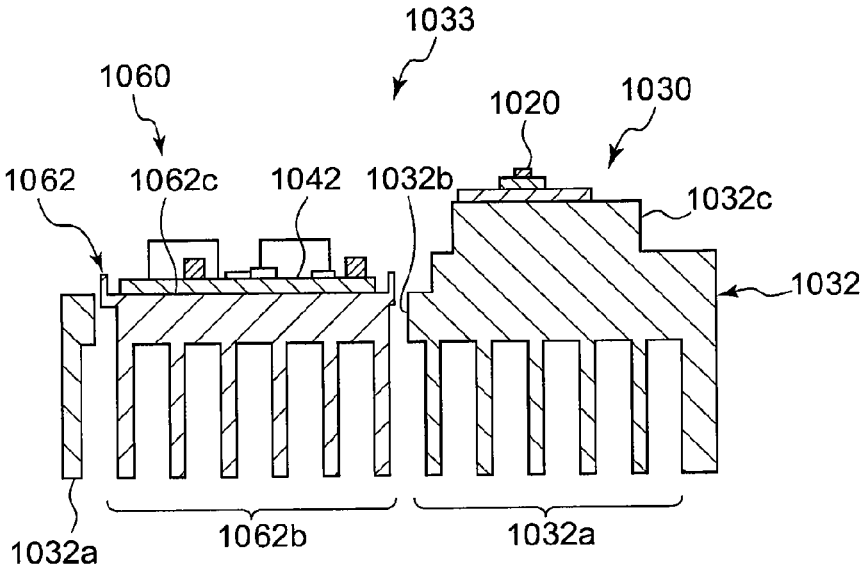
FIG. 21B is a cross-sectional view of FIG. 20A taken along the line Q-Q.

FIG. 21A is a cross-sectional view of FIG. 20A taken along the line P-P. FIG. 21B is a cross-sectional view of FIG. 20A taken along the line Q-Q. In FIG. 21A, the heat radiation fins 1032*a* are provided in front of and at the back of the second heatsink 1062. Thus, as viewed from the direction parallel to the control circuit board 1042 such as a direction parallel to the optical axis Ax1 of the lamp unit shown in FIG. 21A and a direction perpendicular to the optical axis Ax1 of the lamp unit in FIG. 21B, the heat radiation fin 1062*b* of the second heatsink 1062 is placed such that the heat radiation fin 1062*b* thereof overlaps with the heat radiation fins 1032*a* of the first heatsink 1032. As a result, the height of the attachment unit 1033 can be reduced as compared with the case where the first heatsink 1032 and the second heatsink 1062 are placed such that they do not overlap with each other as viewed from the direction parallel to the control circuit board 1042, namely the case where they are placed in different positions vertically. This avoids a larger size for the light-emitting module 1014 resulting from the provision of both the first heatsink 1032 and the second heatsink 1062.

The heat radiation fins 1062*b* of the second heatsink 1062 extend to a position approximately identical to the position of the heat radiation fins 1032*a* of the first heatsink 1032 in a direction perpendicular to the control circuit board 1042. This enables more effective use of space in the height direction than in the case where the heights of them are made to differ from each other.

As shown in FIG. 21A, the control circuit board 1042 is mounted to the circuit holding section 1034*a* via the second heatsink 1062 for radiating the heat generated by the control circuit board 1042. In this setting, the first heatsink 1032 and the second heatsink 1062 are fixed to each other with the attachment 1034 held between the first heatsink 1032 and the second heatsink 1062. Also, the second heatsink 1062 is configured such that the second heatsink 1062 is not in contact with the first heatsink 1032 when the first heatsink 1032 is mounted on the bottom face 1034*e* of the attachment 1034.

The circuit holding section 1034*a* of the attachment 1034 is formed of a material whose thermal conductivity is lower than that of the first heatsink 1032 and that of the second heatsink 1062. Accordingly, the attachment 1034 is formed of a material whose thermal conductivity is lower than that of the first heatsink 1032 and that of the second heatsink 1062. Thus the attachment 1034 functions as a heat separation member for separating the heat generated by the light-emitting element 1020 from the heat generated by the control circuit board 1042 and vice versa. Placing the first heatsink 1032 and the second heatsink 1062 close to each other avoids the transfer of heat generated from one of the light-emitting element 1020 and the control circuit board 1042 to the other thereof.

Also, the heat radiation fins 1062*b* are provided such that a portion of the heat radiation fins 1062*b* disposed counter to an approximate center of the control circuit board 1042 extends downward as viewed from a direction parallel to the optical axis Ax1 of the lamp unit. The heat radiation fins 1062*b* are not provided in an area disposed counter to a vicinity of both ends of the control circuit board 1042. It is generally easier to locate the electronic components, which are likely to produce heat, in the center of the control circuit board 1042 than to locate them in the vicinity of both ends of the control circuit board 1042. In this manner, the heat radiation fins 1062*b* are provided such that the portion thereof disposed counter to an approximate center of the control circuit board 1042 extends downward, and the components, which are likely to produce heat in the control circuit board 1042, are located in the center of the control circuit board 1042. With this configuration, the heat generated by the control circuit board 1042 can be efficiently radiated by the heat radiation fins 1062*b*.

It is appreciated that the heat radiation fins 1062*b* may be provided such that portions of the heat radiation fins 1062*b* disposed counter to predetermined positions other than the approximate center of the control circuit board 1042 extend downward as viewed from a predetermined direction parallel to the control circuit board 1042. Also, the heat radiation fins 1062*b* may be provided such that the portions disposed counter to the predetermined positions of the control circuit board 1042 extend longer in a direction perpendicular to the control circuit board 1042 than a predetermined position other than said predetermined positions.

As shown in FIG. 21B, the first heatsink 1032 has a projecting part 1032*c*. The projecting part 1032*c* projects upward from the circuit laying surface 1062*c* such that the light-emitting element 1020 vertically protrudes higher than the control circuit board 1042. In the eighth embodiment, the cover 1040 and the shade section 1018*a* are located above the control circuit board 1042. Thus the projecting part 1032*c* is formed as follows. That is, the projecting part 1032*c* projects upward from the circuit laying surface 1062*c* such that the light-emitting portion of the light-emitting element 1020 is located higher than the top surface of the shade section 1018*a*.

Figure 22:
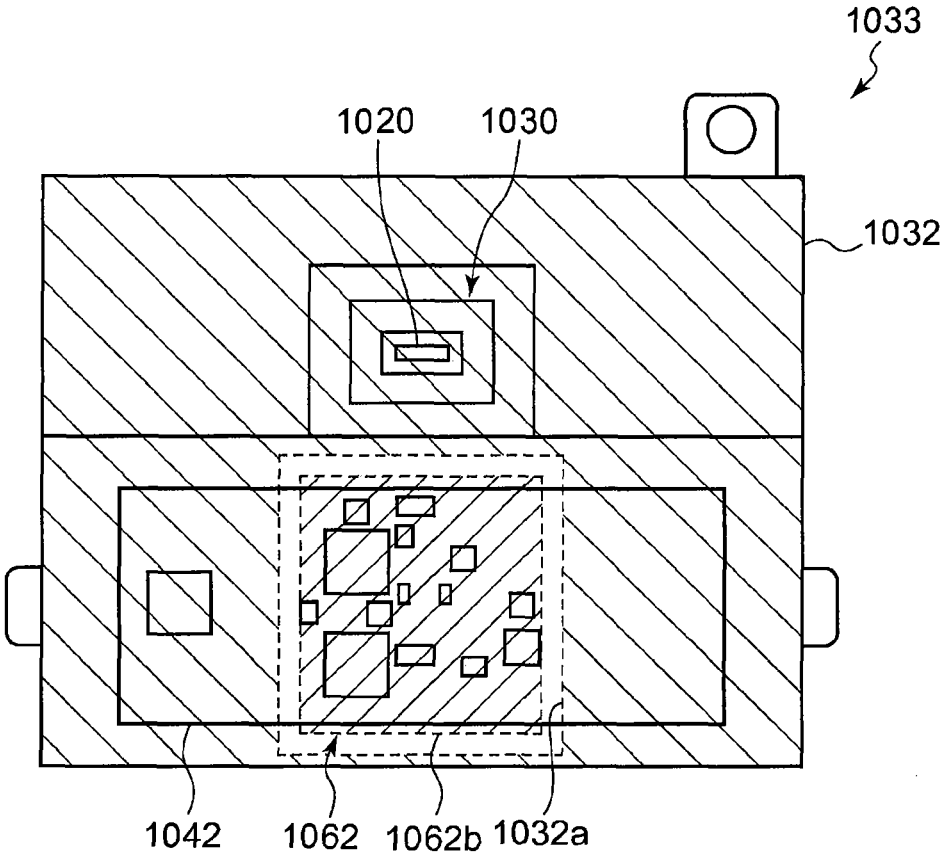
FIG. 22 shows a region where heat radiation fins of a first heatsink are provided and a region where heat radiation fins of a second heatsink are provided, in the top view of the attachment unit.

FIG. 22 shows a region where the heat radiation fins 1032*a* of the first heatsink 1032 are provided and a region where heat radiation fins 1062*b* of a second heatsink 1062 are provided, in the top view of the attachment unit 1033.

As shown in FIG. 22, the heat radiation fin 1032*a* of the first heatsink 1032 is provided such that the heat radiation fin

1032*a* thereof overlaps with a vicinity of both ends of the control circuit board 1042 as seen from a direction perpendicular to the control circuit board 1042. As described already, the heat radiation fin 1062*b* is provided in the position disposed counter to an approximate center of the control circuit board 1042 but no heat radiation fin 1062*b* is provided in the vicinity of both ends of the control circuit board 1042. Thus the heat radiation fins 1032*a* are provided in this space, thereby increasing the layout area of the heat radiation fins 1032*a*.

As described above, cooling the light-emitting element 1020 is in a greater need than cooling the control circuit board 1042. Note here that the area of the control circuit board 1042 is generally wide. Thus, suppose that the heat radiation fins 1062*b* having an area approximately identical to the area of the control circuit board 1042 are to be provided so that the height required to cool the control circuit board 1042 can be set for the heat radiation fins 1062*b*. Then, the height of the heat radiation fins 1062*b* for cooling the control circuit board 1042 may possibly be smaller than the height of the heat radiation fins 1032*a* for cooling the light-emitting element 1020. Note here also that the heat radiation fin 1032*a* and the opening 1032*b* are located at the same position as the control circuit board 1042 in a vertically direction. If, however, the heights of the heat radiation fins 1032*a* and the heat radiation fins 1062*b* differ from each other, it will be difficult to utilize a space otherwise caused by the difference in height between the heat radiation fins 1032*a* and the heat radiation fins 1062*b*.

In this manner, the heat radiation fins 1062*b* for cooling the control circuit board 1042 are provided in only a position disposed counter to a part of the control circuit board 1042, and the heat radiation fins 1032*a* for cooling the light-emitting element 1020 are provided in positions disposed counter to other parts of the control circuit board 1042. With this configuration, the fins having areas appropriate for their cooling necessity can be suitably provided while the difference in height between the heat radiation fins 1032*a* and the heat radiation fins 1062*b* is minimized. It should be noted that a region where the first heatsink 1032 and the control circuit board 1042 overlap with each other is not limited to the vicinity of ends of the control circuit board 1042. For example, the first heatsink 1032 may be provided such that the first heatsink 1032 overlaps with other parts of the control circuit board 1042 as viewed from a direction perpendicular to the control circuit board 1042.

Ninth Embodiment

A ninth embodiment relates to a light source fixing member and, in particular, to a light source fixing member that secures a light source to a heat radiation member for dissipating the heat generated by the light source.

In the automotive headlamps being used, for example, there are cases where a control circuit for controlling the lighting of the light-emitting elements is provided independently of the mounting substrate to which the light-emitting elements are directly mounted. Electrically connecting the light source to this control circuit promptly at the time of manufacturing leads to the improvement of the productivity. In the technique according to the above-cited reference, however, the control circuit and the light source cannot be directly connected together and the control circuit must be connected to the attachment separately. There is thus room for improvement in this regard.

The ninth embodiment is implemented to solve the aforementioned problems, and a purpose thereof is to quickly connect the light source and the control circuit for controlling the lighting of the light source.

To resolve the foregoing problems, a light source fixing member according to the ninth embodiment includes a heat radiation member mounting section mounted to a light source heat radiation member for radiating the heat of a light source, a light source fixing section that secures the light source to the light source heat radiation member by mounting the heat radiation member mounting member to the light source heat radiation member, a circuit mounting section to which a control circuit unit for controlling the lighting of the light source is mounted, and a conductive member connected to the control circuit unit. The conductive member is so provided that when the heat radiation member mounting section is mounted to the light source heat radiation member, the conductive member comes in contact with the electrodes of the light source and thereby conducts electricity between the control circuit unit and the light source.

According to this embodiment, the light source fixing member is mounted to the heat radiation member, thereby conducting electricity between the light source and the control circuit unit. Thus the number of processes required by the manufacturing personnel or the overall man-hours can be reduced.

The light source fixing member may further including a wiring section, formed of a resin, in which the conductive member is led and wired to a connector to the control circuit unit. At least part of the conductive member may be molded integrally with the wiring section. According to this embodiment, the number of processes required for the wiring of the conductive members can be reduced and therefore the productivity of the light-emitting apparatuses can be improved.

The control circuit unit may be mounted to the circuit mounting section through the medium of a circuit heat radiation member for radiating the heat generated by the control circuit unit. According to this embodiment, the heat produced by control circuit unit can be radiated independently of the light source radiation member. Thus, the thermal effect of one of the control circuit unit and the light source on the other thereof can be suppressed as compared with the heat generated by the control circuit unit and the heat generated by the light source are radiated using the same single heat radiation member only.

The circuit heat radiation member may be configured such that the circuit heat radiation member is not in contact with the light source heat radiation member when the heat radiation member mounting section is mounted to the light source heat radiation member. Also, the circuit mounting section may be formed by a material whose thermal conductivity is lower than that of the light source heat radiation member and that of the circuit heat radiation member. According to this embodiment, the control circuit unit and the light source can be electrically connected to each other through the attachment. At the same time, the control circuit unit and the light source can be thermally independent of each other and therefore the thermal effect of one of the control circuit unit and the light source on the other thereof can be further suppressed.

According to this embodiment, the light source and the control circuit unit for controlling the lighting of the light source can be promptly connected to each other.

Figure 23:
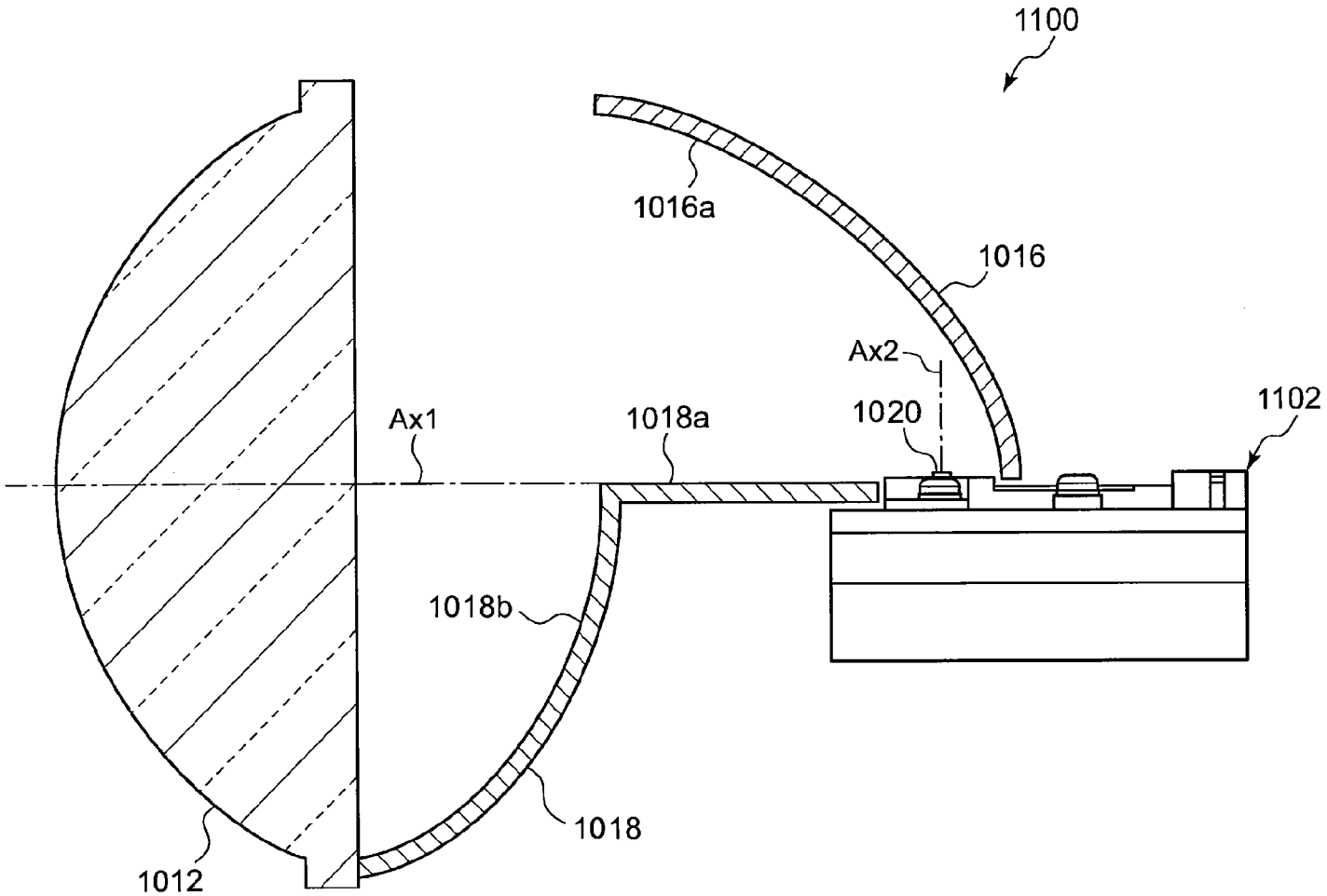
FIG. 23 shows a structure of an automotive headlamp according to a ninth embodiment.

FIG. 23 shows a structure of an automotive headlamp 1100 according to a ninth embodiment. Hereinbelow, the components identical to those of the eighth embodiment are given the identical reference numerals, and the repeated description thereof will be omitted. The automotive headlamp 1100 is configured similarly to the automotive headlamp 1010 of the eighth embodiment except that a light-emitting module 1102 is provided in the place of the light-emitting module 1014.

Figure 24:
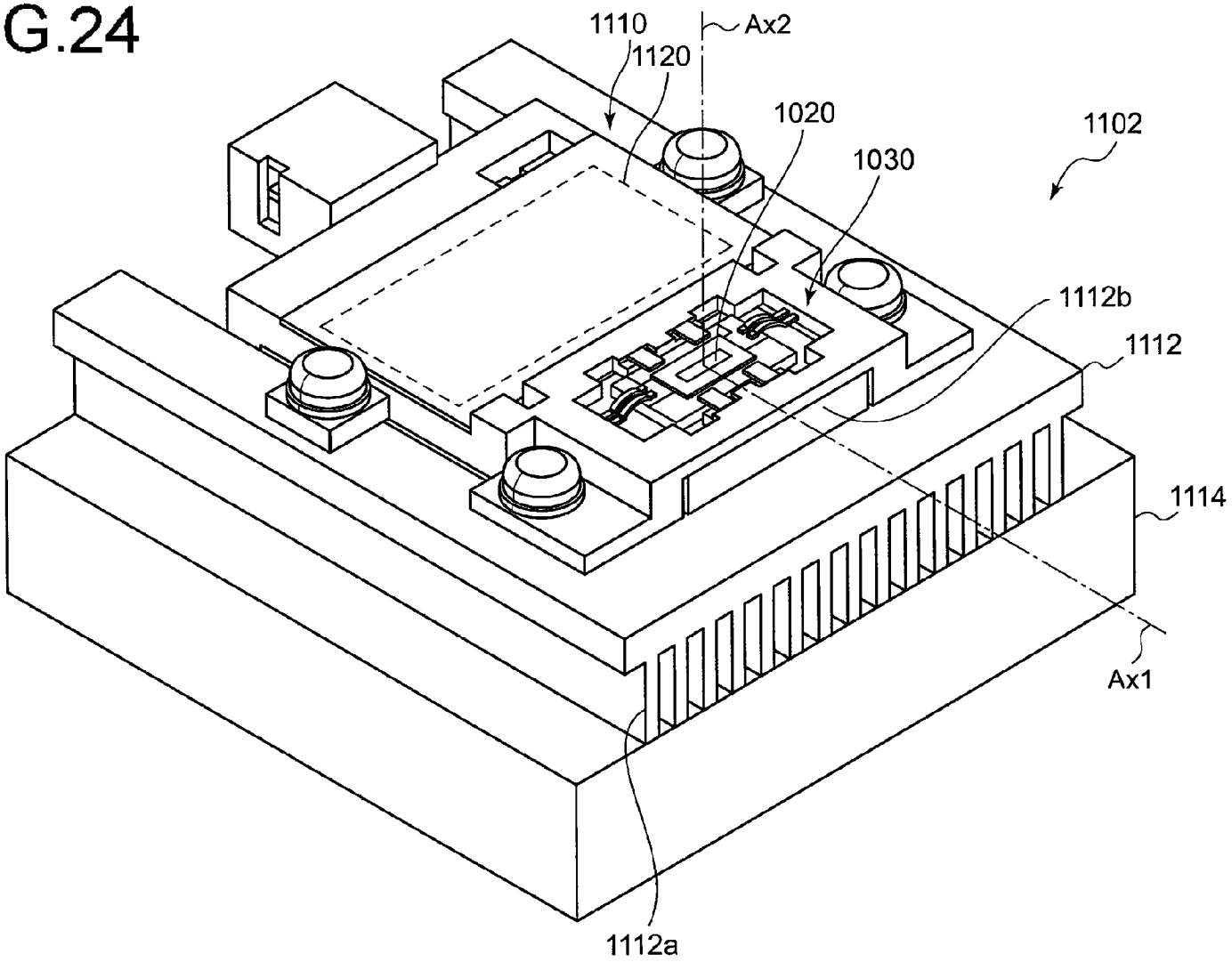
FIG. 24 is a perspective view of a light-emitting module according to a ninth embodiment.

FIG. 24 is a perspective view of the light-emitting module 1102 according to the ninth embodiment. The light-emitting module 1102, which functions as a light-emitting apparatus, includes an attachment unit 1110, a package 1030, a first heatsink 1112, and a fan 1114. The attachment unit 1110 includes a control circuit board 1120. The control circuit board 1120 controls the lighting of the light-emitting element 1020. In the ninth embodiment, too, the control circuit board 1120 is configured by a printed-circuit board and electrical components and elements mounted on the printed-circuit board. In the ninth embodiment, too, the light-emitting module 1102 has the light-emitting element 1020 as the light source and the control circuit board 1120 controlling the lighting of the light-emitting element 1020 integrally structured together.

The first heatsink 1112 is made of a highly heat radiant material, such as aluminum, and functions as a heat radiation member. The first heatsink 1112 has heat radiation fins 1112*a* that radiate heat generated by the light-emitting element 1020 and the control circuit unit 42. The first heatsink 1112 is mounted on the bottom face of an attachment 1122. Thus, the bottom face of the attachment 1122 functions as a heat radiation member mounting section.

The heat radiation fins 1112*a* of the first heatsink 1112 are provided in a lower part of the first heatsink 1112. The heat radiation fins 1112*a* are provided in such a manner as to extend in a direction parallel to the optical axis Ax1 of the lamp unit. The fan 1114 is mounted to the first heatsink 1112 below the heat radiation fins 1112*a* such that the fan 1114 can blow air to the heat radiation fins 1112*a*.

Figure 25:
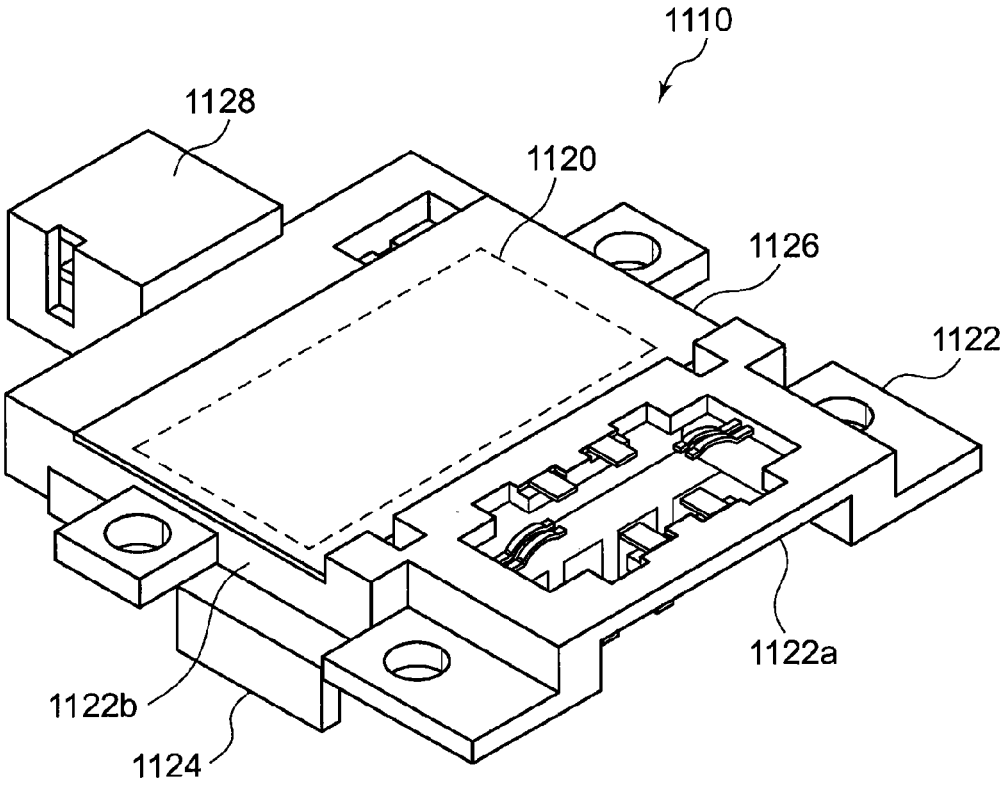
FIG. 25 is a perspective view of an attachment unit according to a ninth embodiment.

FIG. 25 is a perspective view of the attachment unit 1110 according to the ninth embodiment. The attachment unit 1110 is comprised of an attachment 1122, a control circuit board 1120, and a cover 1126.

The attachment 1122 also has a circuit holding section 1122*b* which is a downward recess to hold the control circuit board 1120 for controlling the lighting of the light-emitting element 1020. The control circuit board 1120 is mounted to the circuit holding section 1122*b*. Thus the circuit holding section 1122*b* functions as a circuit mounting section.

In the ninth embodiment, the control circuit board 1120 and the cover 1126 are installed in advance on the attachment 1122 before the attachment 1122 is mounted on the first heatsink 1112, and the control circuit board 1120 and the cover 1126 are mounted on the first heatsink 1112 as the attachment unit 1033. At this time, the cover 1126 covers the entire upper side of the control circuit board 1120. Note that the cover 1126 may be so provided as to cover at least part of the control circuit board 1120. In this manner, the attachment 1122 and the control circuit board 1120 are mounted integrally on the first heatsink 1112, and at the same time the package 1030 is installed in such a manner as to be held between the attachment 1122 and the first heatsink 1112.

In the ninth embodiment, the control circuit board 1120 is located in a position posterior to the light-emitting element 1020 in the lamp unit. The light-emitting module 1102 is disposed such that the main optical axis Ax2 of the light-emitting element 1020 is oriented vertically upward.

The attachment 1122 has a fixed connector 1128 integrally secured thereto by a resin integral molding. A fixed connector 1128 is so provided as to allow connection of a wire connector. The fixed connector 1128 is provided such that the wire connector can be connected with the fixed connector 1128 by moving the wire connector toward the front area of the lamp unit.

Figures 26A, 26B, 26C:
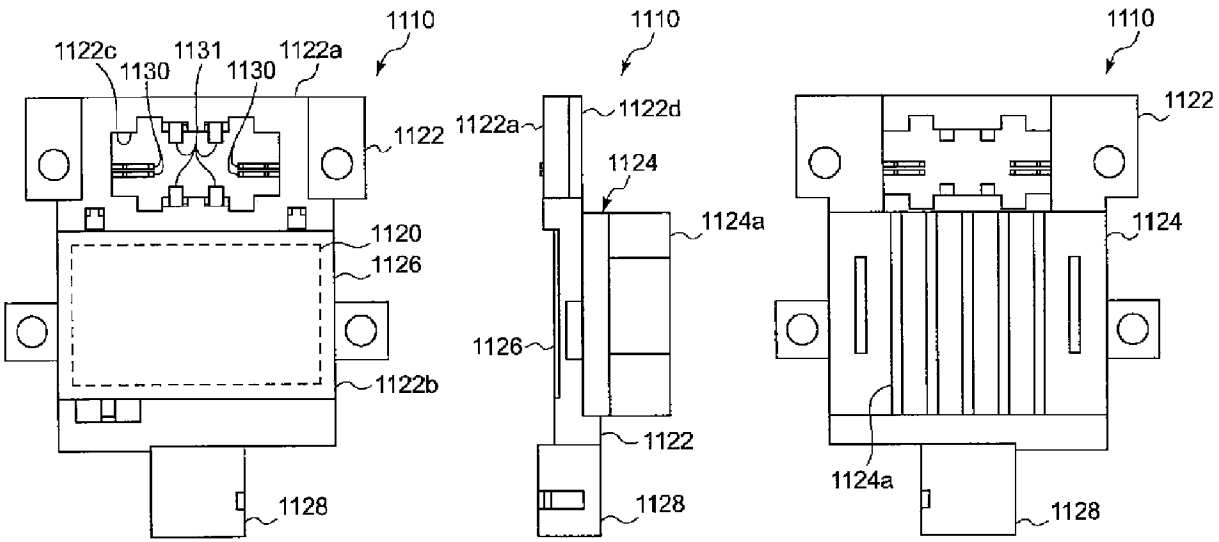
FIG. 26A is a front view of an attachment unit.
FIG. 26B is a left side view of an attachment unit.
FIG. 26C is a bottom view of an attachment unit.

FIG. 26A is a front view of the attachment unit 1110. FIG. 26B is a left side view of the attachment unit 1110. FIG. 26C is a bottom view of the attachment unit 1110. The attachment 1122 includes a package securing section 1122*a*, a circuit holding section 1122*b*, and an opening 1122*c*.

The attachment unit 1110 is further constituted by a second heatsink 1124. The control circuit board 1120 for controlling the lighting of the light-emitting element 1020 is mounted to the second heatsink 1124. The second heatsink 1124 functions as a heat radiation member with which the heat generated by the control circuit board 1120 is radiated. Thus, the first heatsink 1112 and the second heatsink 1124 function as a heat radiation mechanism for radiating the heat generated by the light-emitting element 1020 and the control circuit board 1120.

The first heatsink 1112 is mounted on a bottom face 1122*d* of the attachment 1122, so that the package securing section 1122*a* holds the package 1030 between the first heatsink 1112 and the package securing section 1122*a* and thereby secures the package 1030. As a result, the light-emitting element 1020 is secured.

The package securing section 1122*a* has an opening 1122*c*, conductive members 1130, and plate springs 1131. The opening 1122*c* allows the light-emitting element 1020 to pass through from below and is formed such that the light-emitting element 1020 protrudes higher than the top face of the attachment 1122. The conductive member 1130 is so formed as to protrude toward the inside of the opening 1122*c*. The conductive member 1130 is so provided that when the first heatsink 1112 is mounted on the bottom face 1112*d* of the attachment 1122, the conductive member 1130 comes in contact with the electrodes of the light-emitting element 1020 and thereby conducts electricity between the control circuit board 1120 and the light-emitting element 1020. When the attachment 1122 is mounted to the first heatsink 1112, the plate spring 1131 presses the package 1030 against the first heatsink 1112 so as to secure the package 1030 thereto. Thus the plate springs 1131 function as the pressing members that press the package 1030.

In the attachment 1122, the conductive members 1130 are led up to connectors of the control circuit board 1120, respectively. Thus a part of the attachment 1122 between the package securing section 1122*a* and the connectors function as a wiring section (space) used to lead and wire the conductive members 1130. The connectors and the control circuit board 1120 are connected together by wire bonding, whereas the conductive members 1130 are connected to the control circuit board 1120. The conductive members 1130, except for portions of the conductive members 1130 protruding from the opening 1122*c* and those exposed to the connectors, are integrally formed with the attachment 1122.

Figure 27:
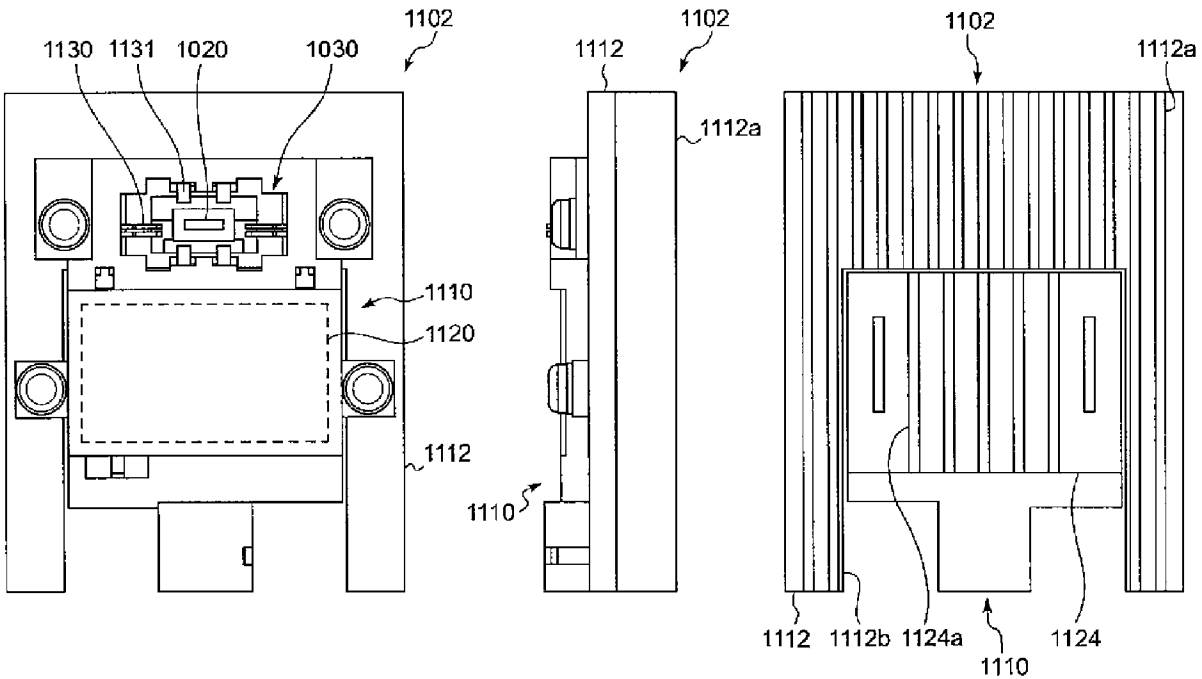
FIG. 27A is a front view of a light-emitting module.
FIG. 27B is a left side view of a light-emitting module.
FIG. 27C is a bottom view of a light-emitting module.

FIG. 27A is a front view of the light-emitting module 1102. FIG. 27B is a left side view of the light-emitting module 1102. FIG. 27C is a bottom view of the light-emitting module 1102. As shown in FIG. 27B and FIG. 27C, the heat radiation fins 1112*a* are provided in a lower part of the first heatsink 1112, and the heat radiation fins 1124*a* are provided in a lower part of the second heatsink 1124. As shown in FIG. 27C, the first heatsink 1112 has an opening 1112*b* through which the heat radiation fins 1124*a* of the second heatsink 1124 are inserted. The heat radiation fins 1124*a* are inserted through this opening 1112*b*. In this setting, the second heatsink 1124 is configured such that the second heatsink 1124 is not in contact with the first heatsink 1112.

The heat radiation fins 1112*a* of the first heatsink 1112 and the heat radiation fins 1124*a* of the second heatsink 1124 are provided in such a manner as to extend in parallel with a direction parallel to the optical axis Ax1 of the lamp unit. The heat radiation fins 1124*a* extend in the same direction as the heat radiation fins 1112*a* and therefore air can smoothly flow therethrough. The fan 1036 is mounted to the first heatsink 1112 below the heat radiation fins 1112*a* and the heat radiation fins 1124*a* such that the fan 1036 can blow air to the heat radiation fins 1112*a* and the heat radiation fins 1124*a*.

The present invention is not limited to the above-described embodiments only, and those resulting from any appropriate combination of components in the embodiments are also effective as embodiments. Also, it is understood by those skilled in the art that various modifications such as changes in design may be added to the embodiments based on their knowledge and embodiments added with such modifications are also within the scope of the present invention.

What is claimed is:

1. A heat radiation mechanism comprising: a first heat radiation member configured to radiate heat of a light source; and a second heat radiation member configured to radiate heat generated by a control circuit board for controlling the lighting of the light source, the second heat radiation member being placed such that the second heat radiation member overlaps with at least part of the first heat radiation member as viewed from a first direction parallel to the control circuit board, wherein the first heat radiation member is placed such that the first heat radiation member overlaps with at least part of the control circuit board as viewed from a second direction perpendicular to the control circuit board.

2. A heat radiation mechanism according to claim 1, further comprising a heat separation member whose thermal conductivity is lower than that of the first radiation member and that of the second radiation member, wherein the first heat radiation member and the second heat radiation member are fixed to each other with the heat separation member held between the first heat radiation member and the second heat radiation member.

3. A heat radiation mechanism according to claim 2, wherein the heat separation member has a slit, the slit being formed such that an area of contact between the first heat radiation member and the second radiation member is small.

4. A heat radiation mechanism according to claim 1, wherein the second heat radiation member is formed such that a portion of the second heat radiation member disposed counter to an approximate center of the control circuit board protrudes more in the second direction than a portion thereof disposed counter to a predetermined edge vicinity portion of the control circuit board, and wherein the first heat radiation member is provided such that the first heat radiation member overlaps with the predetermined edge vicinity portion of the control circuit board as viewed from the second direction.

5. A light-emitting apparatus including a heat radiation mechanism according to claim 1.

6. A light source fixing member comprising: a heat radiation member mounting section configured to be mounted to a light source heat radiation member for radiating heat of a light source; a light source fixing section configured to secure the light source to the light source heat radiation member by mounting the heat radiation member mounting member to the light source heat radiation member; a circuit mounting section to which a control circuit unit for controlling the lighting of the light source is mounted; and a conductive member configured to be connected to the control circuit unit, wherein the conductive member is so provided that when the heat radiation member mounting section is mounted to the light source heat radiation member, the conductive member comes in contact with electrodes of the light source and conducts electricity between the control circuit unit and the light source.

7. A light source fixing member according to claim 6, further comprising a wiring section, formed of a resin, in which the conductive member is led and wired to a connector to the control circuit unit, wherein at least part of the conductive member is molded integrally with the wiring section.

8. A light source fixing member according to claim 6, wherein the control circuit unit is mounted to the circuit mounting section through the medium of a circuit heat radiation member for radiating heat generated by the control circuit unit.

9. A light source fixing member according to claim 8, wherein the circuit heat radiation member is configured such that the circuit heat radiation member is not in contact with the light source heat radiation member when the heat radiation member mounting section is mounted to the light source heat radiation member, and wherein the circuit mounting section is formed by a material whose thermal conductivity is lower than that of the light source heat radiation member and that of the circuit heat radiation member.

* * * * *